United States Patent [19]

Urabe

[11] Patent Number: 5,045,443

[45] Date of Patent: Sep. 3, 1991

[54] SILVER HALIDE PHOTOGRAPHIC EMULSION

[75] Inventor: Shigeharu Urabe, Kanagawa, Japan

[73] Assignee: Fuji Photo Film Co., Ltd., Kanagawa, Japan

[21] Appl. No.: 206,141

[22] Filed: Jun. 13, 1988

[30] Foreign Application Priority Data

Jun. 12, 1987 [JP] Japan ..... 62-146629

[51] Int. Cl.[5] ..... G03C 1/35

[52] U.S. Cl. ..... 430/567; 430/569

[58] Field of Search ..... 430/567, 569

[56] References Cited

U.S. PATENT DOCUMENTS

| | | | |
|---|---|---|---|
| 4,399,215 | 8/1983 | Wey | 430/567 |
| 4,433,048 | 2/1984 | Solberg et al. | 430/434 |
| 4,710,455 | 12/1987 | Iguchi et al. | 430/567 |
| 4,713,323 | 12/1987 | Maskasky | 430/569 |
| 4,769,315 | 9/1988 | Suda et al. | 430/567 |

FOREIGN PATENT DOCUMENTS 75337 3/1986 Japan .

OTHER PUBLICATIONS

Mitchell, "Crystal Imperfection and Chemical Reactivity", Physical Society Bristol Conference, 1954.

Mitchell, "Quantitative Aspect of the Concentration Theory of Latent Image Formation", Nihon Shashin Gakkaishi, vol. 48, pp. 191-204.

*Primary Examiner*—Charles L. Bowers, Jr.

*Assistant Examiner*—Mark R. Buscher

*Attorney, Agent, or Firm*—Sughrue, Mion, Zinn, Macpeak & Seas

[57] ABSTRACT

A silver halide photographic emulsion comprising a dispersant and silver halide grains, at least 50% of the total projected area of the silver halide grains being occupied by tabular grains having an average aspect ratio of 2 or more, the tabular grains comprising opposing parallel major faces consisting of a (1 1 1) face, and at least 30% of the tabular grains having an indentation or space in the central portion of the major faces thereof.

12 Claims, 4 Drawing Sheets

SILVER HALIDE PHOTOGRAPHIC EMULSION

FIELD OF THE INVENTION

The present invention relates to a silver halide photographic emulsion. More particularly, the present invention relates to a silver halide photographic emulsion having an improved sensitivity, fog inhibiting property and development speed, and a process for the preparation thereof.

BACKGROUND OF THE INVENTION

Tabular silver halide grains (hereinafter referred to as "tabular grains") containing parallel twinning faces exhibits the following photographic properties:

(1) Tabular grains have a large ratio of surface area to volume (hereinafter referred to as "specific surface area") and therefore can adsorb a large amount of a sensitizing dye by its surface. As a result, tabular grains exhibit a high color-sensitized sensitivity relative to inherent sensitivity.

(2) When an emulsion containing tabular grains is coated on a support and dried, these grains are oriented parallel with the surface of the support. This means that tabular grains can provide a thin coated layer which exhibits excellent sharpness.

(3) In X-ray photograph systems, when a sensitizing dye is added to tabular grains, the absorptivity coefficient of the dye is larger than the absorptivity coefficient of the indirect transition of silver halide (AgX), making it possible to remarkably decrease crossover light. This can prevent deterioration in image quality.

(4) Tabular grains scatter little light and therefore, can provide images having a high resolving power.

(5) Tabular grains have a low sensitivity to blue light. Therefore, if tabular grains are used for a green-sensitive emulsion layer or red-sensitive emulsion layer, a yellow filter can be removed from the emulsion.

Having so many advantages, tabular grains have heretofore been used for high sensitivity commercial light-sensitive materials.

Emulsion grains having an aspect ratio of 8 or more are disclosed in Japanese Patent Application (OPI) Nos. 113926/83, 113927/83, and 113928/83 (the term "OPI" as used herein means a "published unexamined Japanese patent application").

The term "aspect ratio" as used herein means the ratio of diameter to thickness of the tabular grain. The grain diameter can be represented by the diameter of the circle having the same area as the projected area of the grain when the emulsion is observed under a microscope or electron microscope. The grain thickness can be represented by the distance between the two parallel faces constituting the tabular silver halide grains.

U.S. Pat. No. 4,439,520, describes a color photographic light-sensitive material which comprises tabular grains having a thickness of less than 0.3 μm and a diameter of 0.6 μm or more in at least one of green-sensitive emulsion layer and red-sensitive emulsion layer to improve sharpness, sensitivity and graininess.

Tabular grains have a large ratio of surface area to volume. This is advantageous with regard to property (1) noted above. However, this causes a disadvantage in the light-sensitive process. Particularly, electrons produced by the exposure to light migrate in the silver halide grains and are then concentrated on a specific point to form latent images. This phenomenon is called the "concentration principle" in silver halide. This is one of main reasons why silver halide has high photographic sensitivity. However, the distance of travel of these electrons thus produced is finite at normal temperatures and is relatively small. Tabular grains have a wider expansion in the direction parallel with the major faces. Therefore, as compared to isotropic crystals (such as cubic, tetradecahedric and octahedric), electrons need to travel a longer distance in grains having the same volume in order to attain such a concentration effect.

A study of this concentration principle is described in J. W. Mitchell, *Quantitative Aspect of the Concentration Theory of Latent Image Formation,* Nihon Shashin Gakkaishi, Vol. 48, No. 3, 1985, pp. 191–204. Mitchell suggests that the prevention of dispersion of latent images formed on tabular grains due to such a prolonged electron travel distance may be attained by concentrating electrons on specific points in the tabular grains (e.g., the apexes of the grains, preferably the central portion of the major faces of the grains) to determine the sites for latent image formation.

Furthermore, the concentration of the latent images is a very important factor with regard to the latent image development rate. In general, a chemically-unsensitized emulsion provides a low sensitivity but gives one latent image per one grain. As a result, such an emulsion exhibits a high development rate even at a high intensity exposure which easily causes latent image dispersion. One the other hand, a sulfur-sensitized emulsion has a higher sensitivity but gives a plurality of latent images per one grain (i.e., Poisson distribution). As a result, the development rate is decreased. This phenomenon is caused by the drop in development activity of each latent image due to dispersion of latent images. This fact is described in H. E. Spencer and R. E. Atwell, *Journal of Optical Society American,* Vol. 54, 1964, pp. 498. It is therefore indispensable that specific points enabling concentration of latent images be formed in the tabular grains in order to assure a high development rate. It goes without saying that the number of these specific points should be as small as possible. Heretofore, a number of techniques have been studied to enable the concentration of latent images. For example, G. C. Farnell, R. B . Flint and J. B. Chanter, "Preferred Sites for Latent Image", *Journal Photographic Science,* Vol. 13, 1965, pp. 25–31 suggests that these is a close relationship among the sites for latent image formation, structural distortion in grains, and points at which the structural distortion and the grain edge cross each other in tabular silver halide grains having a large size and a high aspect ratio. However, Farnell et al. suggests no method for coordinating this structural distortion in these specific points. Japanese Patent Application (OPI) No. 108526/83 discloses an emulsion of tabular grains having an average aspect ratio of 8 1 or more, characterized in that a silver salt is coordinated on selected positions on parallel opposing (1 1 1) major faces thereof. In this disclosure, the concentration of iodide is controlled between the center of the major face and its surrounding portion so that AgCl is coordinated in the apex or the center of the tabular grains. Furthermore, a site director is adsorbed by the tabular grains so that AgCl is epitaxially coordinated.

This coordination (epitaxy) of AgCl (or other silver salt such as AgSCN) might le effective to restrict the sites for latent image formation. However, such coordination is disadvantageous in that it is subject to change during the subsequent procedures such as rinse, chemical sensitization, coating, and incubation of coated matter due to its high solubility or its tendency to form a mixed crystal with host grains. Therefore, such coordination can hardly maintain its properties.

Japanese Patent Application (OPI) No. 133540/84 discloses a silver halide emulsion containing a silver salt, coordinated epitaxially on selected surface portions on host grains of silver halide having an average aspect ratio of 8:1 or less surrounded by (1 1 1) crystal faces. In this disclosure the host grains do not contain a sufficient amount of iodide to coordinate a silver salt. The coordination of a silver salt is accomplished by allowing a site director to be adsorbed by the host grains.

Japanese Patent Application (OPI) No. 75337/86 discloses a silver halide emulsion containing silver halide grains having a hollow bore portion extending from the surface to the internal portion thereof. However, this disclosure contains no methods for controlling the site for and number of these hollows. Therefore, this approach is not sufficient to concentrate latent images on a small number of specific points.

Japanese Patent Application (OPI) No. 106532/83 discloses a monodispersed emulsion of octahedron or tetradecahedron crystal silver halide grains having an indentation in the center of (1 1 1) faces. Also, J. W. Mitchell, *Crystal Imperfection and Chemical Reactivity,* Physical Society Bristol Conference, 1954, describes that when a tabular silver bromide grain is etched with a silver halide solvent, etched pits can be specifically etched in the apexes, edges or center of the tabular grains (hexagonal or triangular). In this approach, however, the preparation of tabular grains is accomplished by cooling a saturated solution of silver bromide which has been heated to an elevated temperature. Furthermore, protective colloid such as g<latin are not used. Therefore, this approach cannot be put into practical use in the preparation of a photographic emulsion. Moreover, this approach deals with only silver bromide grains. In this approach, the grain size to be treated is macro size and no consideration is given to the properties of emulsion.

J. W. Mitchell, *Quantitative Aspect of the Concentration Theory of Latent Image Formation,* Nihon Shashin Gakkaishi, Vol. 48, 1985, pp. 191 -204, describes a process for the preparation cf thin tabular grains containing silver iodobromide nucleus in the center thereof, surrounded by a silver bromide phase. J. W. Mitchell also describes that when such tabular grains are treated with a solution of potassium thiocyanate, the grains are dissolved in the center thereof. If this treatment is prolonged, a hole is made in the center of the grains, according to Mitchell. It is believed that the selective dissolution is caused by crystal defect or strain in the center of the grains.

As previously described, tabular grains are thin crystals comprising opposing wide (1 1 1) major faces and having various excellent properties. However, since such tabular grains have widely extended major faces, latent images are dispersed if a larger grain size is used to provide a higher sensitivity. Therefore, even if a larger grain size is used, it is difficult to further improve the sensitivity. In order to solve this problem, it is necessary that the sited for latent image formation be restricted, that the number of the sites for latent image formation be decreased, or that a site by which electrons produced by light can be mostly trapped be selected. Furthermore, such a specific site must be a specific site for a light-sensitive nucleus produced at a chemical sensitization process, as well as a site for effective formation of latent images. Moreover, such a specific site must be stable at each step in the preparation of a silver halide emulsion (e.g., grain formation, desalting, chemical sensitization, coating, and drying) as well as under various conditions imposed after the coating on a film base.

Such a specific site can only be accomplished with tabular grains selectively containing an indentation or space in a specific site thereof, that is, the center of the major faces thereof. This cannot be attained by the prior art approaches.

SUMMARY OF THE INVENTION

It is therefore an object of the present invention to provide a tabular grain-containing silver halide emulsion having a high sensitivity, and improved graininess, sharpness and covering power, as well as excellent preservability which can be rapidly developed and a process for the preparation thereof.

The above and other objects of the present invention will become more apparent from the following detailed description and examples.

These objects of the present invention are accomplished with a silver halide photographic emulsion comprising a dispersant and silver halide grains, at least 50% of the total projected area of the silver halide grains being occupied by tabular grains having an average aspect ratio of 2 or more, the tabular grains comprising opposing parallel major faces consisting of a (1 1 1) face, and at least 30% of the tabular grains having an indentation or space in the central portion of the major faces thereof.

DETAILED DESCRIPTION OF THE INVENTION

The present invention will be first described with reference to tabular grains having an indentation or space in the center of the major faces thereof (hereinafter referred to as "CE-grains").

Figure 1:
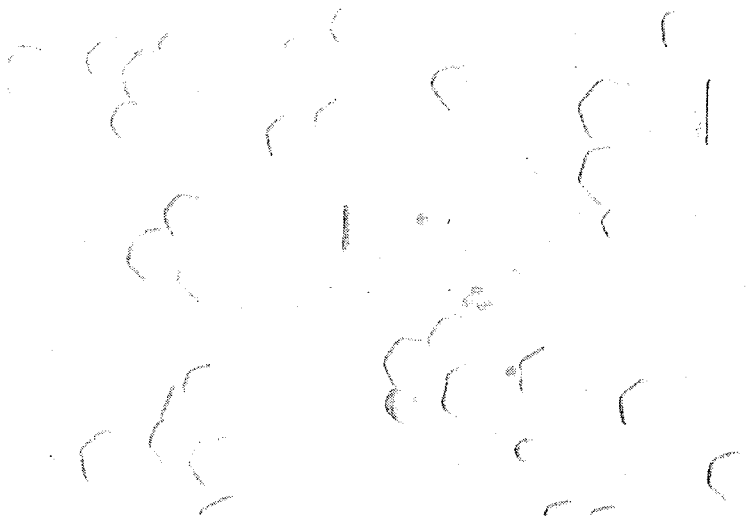
FIGS. 1, 2 and 3 are electronmicrophotograph (×3,000) of silver halide crystal grains in Emulsions 1-B, 1-D and 2-D in Examples of the present invention, respectively, in which black spherical particles are polymer latex particles for the measurement of size of the emulsion grains.

CE-grains have an indentation or space in the center of major faces which are opposed in parallel to each other of tabular grains. CE-grains have a specific inner face in the central portion thereof, which can be definitely confirmed under an electron microscope. FIG. 1 shows an example of an electron micrograph of the CE-grains. This electron micrograph clearly shows that the matrix tabular grains have an indentation in the center of the major face thereof. There is one indentation in the center of the major face, and there are two opposing parallel major faces in one grain. Therefore, one grain has only two indentations. The present invention differs from known silver halide having indentations, as described in Japanese Patent Application (OPI)

No. 106532/83, or bore portions, as described in Japanese Patent Application (OPI) No. 75337/86.

Japanese Patent Application (OPI) No. 106532/83 discloses a silver halide emulsion containing octahedron or tetradecahedron crystal grains having indentations in the center of the (1 1 1) faces. In this case, there are 8 indentations in one grain. In contrast, the present invention relates to a tabular grain having two indentations at most.

Japanese Patent Application (OPI) No. 75337/86 discloses a silver halide emulsion containing silver halide grains having a hollow bore portion running from the surface to the internal portion. However, the site and number of these bore portions can not be specifically determined. Therefore, such an emulsion is quite different from the present invention, which relates to a silver halide emulsion containing tabular silver halide grains having one indentation in the center of both the major faces.

As already described, the maximum sensitivity of the emulsion grains can be realized only by determining the site for formation of latent images at a position such that the trap of electrons produced by light can be most efficiently effected, and limiting the number of the sites to one, so that the integration of latent images can be effected. This can be accomplished only by the present invention.

The indentation mainly occurs in the form of a triangle, but the shape of the indentation depends on the condition under which the matrix tabular grains are processed. The diameter of the indentation is represented in terms of diameter of the projected area thereof. The diameter of the indentation depends on the diameter of matrix tabular grains and preferably ranges from 0.005 to 1.0 μm, particularly 0.005 to 0.6 μm. The depth of the indentation is 50 lattices or more in the <1 1 1> direction perpendicular to (1 1 1) face, preferably 300 lattices or more. Moreover, the depth of the indentation may extend to the opposite face.

The tabular grains of the present invention comprise parallel opposing major faces consisting of a (1 1 1) face and having an average aspect ratio of 2 or more, preferably from 3 to 20, and more preferably from 3 to 15. The grain size of the present tabular grains is 0.4 μm or more, preferably from 0.4 to 4 μm.

The average aspect ratio ($\bar{\gamma}$) can be defined by the following equation:

$$\gamma = \left[ \sum_{i=1}^{N} \frac{D_i}{t_i} / N \right] \quad (1)$$

wherein $D_i$ is the diameter of the circle having the same area as the projected area of the i-th silver halide grain when the tabular silver halide grains are oriented in such an arrangement that two major faces opposing each other in a face are made horizontal with the face; $t_i$ is the thickness of the i-th grain in the direction perpendicular to the two major faces; and N is the number required to and sufficient to give the average aspect ratio to the silver halide grains. In general, the value of N is as follows:

$$N \gtrsim 600 \quad (2)$$

Equation (1) shows that $\gamma$ is given by the mean of the aspect ratio $\gamma_i$ of the silver halide grains. If the silver halide grains are substantially under the condition:

$$t_i \simeq t_j \ (i \neq j;\ i, j \leqq N) \quad (3)$$

or the condition $$D_i/t_i \simeq D_j/t_j \ (i \neq j;\ i, j \leqq N) \quad (4)$$

$\bar{\gamma}'$ defined by Equation (5), substantially equals $\bar{\gamma}$.

$$\gamma' = \left[ \sum_{i=1}^{N} D_i \right] \left[ \sum_{i=1}^{N} t_i \right] \quad (5)$$

Accordingly, if the silver halide grains are within the range of accuracy tolerable in the measurement of grains, the average aspect ratio can be represented by $\gamma'$.

In the process for the preparation of silver halide grains containing the CE-grains of the present invention, the silver halide grains to be processed with a silver halide solvent is preferably monodisperse in shape and grain size. Particularly, as described in Japanese Patent Application No. 299155/86, there may preferably be used a silver halide emulsion in which 70% or more of the total projected area are hexagonal grains having the ratio of the length of the longest side :o that of the shortest side of 2 or less and are occupied by tabular silver halide comprising two parallel faces as outer surface faces. The hexagonal tabular silver halide grain is also preferably monodisperes. In the present invention, the tabular silver halide grains are processed with a solvent so that an indentation is formed in the center of the major surface faces thereof. However, if the shape of the grains are diversified and the grain size is polydisperse, the solubility in the solvent differs from grain to grain, making it impossible to obtain uniform central indentations. Furthermore, silver halide grains having a wide size distribution may cause a physical ripening between tabular grains as the matrix and may preferably be avoided. In the present invention, it is desired that the center of the major faces of the tabular grains be preferentially dissolved by the processing with a silver halide solvent. It is also desired that the other portions (e.g., the corner, edge or major faces) of the tabular grains not be dissolved at all, or only be minimally dissolved. In the present invention, the halogen composition of the tabular grains may be any one of silver bromide, silver iodobromide, silver chlorobromide, and silver chloroiodobromide. The halogen composition of the grains is arranged so that the solubility of the center of the grain is higher than that of the surrounding portion thereof. Such a composition arrangement can be accomplished by changing the proportion of halogen atom constituting silver halide (i.e, chlorine, bromine, or iodine) between the center of the grains and the surrounding portion thereof in the preparation of the tabular grains so that a halogen atom having a higher solubility is incorporated in the canter of the grains.

Examples of such a halogen composition are set forth below:

| Central portion | Surrounding portion | Remarks |
|---|---|---|
| 1. AgCl | AgClBr | |
| 2. AgCl | AgBr | |
| 3. AgCl | AgBrI | |
| 4. AgClBr | AgBrCl | The Br content is at least |

-continued

| Central portion | Surrounding portion | Remarks |
|---|---|---|
| | | 10 mol % lower in the cenral portion than in the surrounding portion. |
| 5. AgClBr | AgBr | The Br content is at least 10 mol % lower in the cenral portion than in the surrounding portion. |
| 6. AgClBr | AgBrI | The Br content is at least 10 mol % lower in the cenral portion than in the sorrounding portion. |
| 7. AgBr | AgBrI | The I content in the surrounding portion is 3 mol % or more. |
| 8. AgBrI | AgBrI | The I content in the central portion is 3 mol % or less. The I content in the surrounding portion is 6 mol % or more. |

In order that the central portion having a higher solubility is preferentially dissolved by the processing with a silver halide solvent, it is necessary that the halogen composition of the central portion reach both the major face surfaces of the tabular silver halide grain, or the very proximity thereof (0.002 μm to 0 μm, particularly 0.01 μm to 0 μm from both the major face surfaces).

Figure 4A:
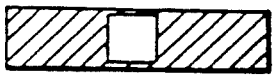
FIG. 4 diagrammatically shows a section of a grain constituting the matrix tabular grains of the present invention, the shade illustrating portions comprising silver halide having a low solubility.

Particularly, FIG. 4 shows a section of the central portion of a tabular grain. In FIG. 4*a*, the central portion having a high solubility reaches to the very proximity of the surface of the grain.

Figure 4B:
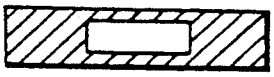

In such a construction, the central portion is easily dissolved with a silver halide solvent. On the other hand, FIG. 4*b* shows a construction in which the central portion having a high solubility is enclosed in the grain and covered by a layer having a lower solubility. In such a construction, the central portion is not preferentially dissolved.

Figure 4C:
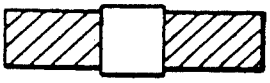

The most suitable grain structure is shown in FIG. 4*c*. In the structure shown in FIG. 4*c*, the proportion of the central portion to the whole tabular grains is from 0.5 to 10% by weight, preferably from 1 to 5% by weight.

The process for the preparation of the tabular grains of the present invention will be described hereinafter. In the present process, a silver halide emulsion containing tabular grains, preferably hexagonal tabular grains, is prepared by the steps comprising nucleation of silver halide grains, first and second Ostwald ripening (hereinafter referred to as "ripening"), and grain growth. The tabular grains thus obtained have an internal structure as shown in FIG. 4*a* or 4*c*.

The preparation of tabular grains in which the central portion comprises silver bromide or silver iodobromide is described below.

(1) Nucleation

The nucleation can be accomplished by adding an aqueous solution of a water-soluble silver salt and an aqueous solution of a halogenated alkali to an aqueous solution containing a dispersant while the pBr value of the latter is kept at 1.0 to 2.5.

The hexagonal tabular grain of present invention has parallel twinning faces inside. The silver halide emulsion of the present invention is characterized by a construction such that the hexagonal tabular grains account for 70% or more of the total projected area of the whole silver halide grains. This can be accomplished by properly controlling the supersaturation factor for the formation of twinning faces in the nucleation conditions. The frequency of the formation of twinning faces during nucleation depends on various supersaturation factors such as the temperature upon nucleation, the gelatin concentration, the rate at which the aqueous solution of silver salt and the aqueous solution of halogenated alkali are added, the Br concentration, the number of revolutions during stirring, and the I content, pH, and salt concentration (e.g., $KNO_3$ and $NaNO_3$) of the aqueous solution of halogenated alkali added. The dependency of the frequency of formation of twinning faces on these factors faces is shown, for example, in the drawings of Japanese Patent Application No. 238808/86. Particularly, such a construction can be accomplished by properly controlling the above-noted supersaturation factors in accordance with the dependency shown in the drawings, so that two twinning faces are likely formed in parallel with each other per one grain during the nucleation and so that the shape of the silver halide grains finally produced fulfills the conditions for the present emulsion. More particularly, such a construction can be accomplished by controlling these supersaturation conditions for the nucleation while observing the replica of the silver halide grains finally produced under a transmission type electromicroscope.

In general, when these supersaturation factors are increased, the grains produced change in sequence as follows:

(a) Regular octahedron grains
(b) Grains having a single twinnig face
(c) Grains having two parallel twinning faces (the desired object of the present invention)
(d) Grains having nonparallel twinning faces
(e) Grains having three or more twinning faces The above described supersaturation factors are controlled so that the proportion of grains (c) in the grains thus produced falls within the range specified in Claims (i.e., at least 50%).

Furthermore, the total supersaturation conditions obtained by a combination of these various supersaturation factors may preferably be kept constant during the nuleation.

The grains according to the examples in French Patent No. 253,406 have a high proportion of triangular tabular grains (grains having three parallel twininng faces). This is believed to be due to the fact that the nucleation is effected under a high supersaturation condition.

Preferred conditions for the nucleation will be described hereinafter.

The dispersant to be used is preferably gelatin. As such gelatin there may be used alkali-treated gelatin, acid-treated gelatin, low molecular weight gelatin (molecular weight: 2,000 to 100,00)), phthalated gelatin, or other modified gelatin.

The gelatin concentration is in the range of from 0.05 to 10% by weight, preferably from 0.05 to 1.6% by weight. The temperature is in the range of from 5° to 48° C., preferably from 15° to 39° C. The pBr is preferably in the range of from 1.0 to 2.5. The content of $I^{\ominus}$ ions which are to be previously incorporated in the solution is preferably in the range of from 3 mol% or less. The rate at which $AgNO_3$ as the water-soluble salt is added to the solution is preferably in the range of from 0.5 to 30 g/min per 1 l of reaction aqueous solution.

The composition of the aqueous solution of a halogenated alkali to be added to the solution is such that the $I^{\ominus}$ ion content as compared to $Br^{\ominus}$ ion is below the solid-solution limit of AgBr I), preferably 10% or less.

The concentration of unrelated salts in the reaction solution is preferably in the range of from 0 to 1 mol/l. The pH value of the reaction solution may be in the range of from 2 to 10. However, if reduction sensitizing silver nuclei are introduced into the reaction solution, the pH value thereof is preferably in the range of from 8.0 to 9.5.

Under the above-described conditions, finely divided grain nucleus having a uniform grain size distribution can be advantageously formed at a temperature of from 15° to 39° C., with a gelatin concentration of from 0.05 to 1.6% by weight.

(2) 1st ripending

In the nucleation step (1), fine tobular grain nuclei can be formed. However, a large number of other finely divided grains (particularly octahedron and single twin grains) are formed at the same time. It is therefore necessary that these grains other than tabular grain nuclei be eliminated before beginning the growth step described below, in order to obtain nuclei having a shape providing tabular grains and which are excellent in monodispersion. As a method for accomplishing this objective, a process is known which comprises Ostwald ripening after nucleation. Since Ostwald ripening proceeds slowly at a low temperature, it should be effected at a temperature of from 40° to 80° C., preferably from 50° to 80° C., from a practical view point. In this process, octahedron and single twin fine grains are dissolved and precipitated as tabular nuclei, whereby a high proportion of tabular grains can be obtained.

In the present invention, the ripening may be preferably effected as follows:

(i) After the nucleation, the gelatin concentration and the pBr value are properly adjusted. The reaction solution is then heated and ripened until the proportion of hexagonal tabular grains reaches the maximum.

(ii) After the nucleation, the gelatin concentration and the pBr value are properly adjusted. The reaction solution is then heated. Only an aqueous solution of $AgNO_3$ or an aqueous solution of $AgNO_3$ and an aqueous solution of a halogenated alkali are added to the reaction solution at a rate such that new nuclei are no longer produced, so that hexagonal tabular grains are selectively allowed to grow, and whereby discrimination is made between hexagonal tabular grains accelerating the stable growth of hexagonal tabular grains and other grains which eliminate hexagonal tabular grains. The reaction solution is then ripened until the proportion of hexagonal tabular grains reaches the maximum.

(iii) After the nucleation, the gelatin concentration and the pBr value are properly adjusted. The reaction solution is then heated. An aqueous solution of $AgNO_3$ and an aqueous solution of a halogenated alkali are then added to the reaction solution at a rate in the range of from 0 to 10%, preferably from 0 to 3% of the critical growth rate, while the reaction solution is ripened until the proportion of hexagonal tabular grains reaches the maximum.

The point at which the proportion of hexagonal tabular grains reaches the maximum can be judged by observing the replica of the grains finally produced under a transmission type electron microscope while changing the ripening time. If the reaction solution is overripened, the proportion of hexagonal tabular grains is generally decreased again, and the size distribution of the grains becomes wider.

The pBr value can be adjusted by any one of the following methods:

(a) After the nucleation, the emulsion is washed with water.

(b) After the nucleation, part of the emulsion thus obtained is withdrawn as crystal species and added to an aqueous solution of gelatin.

(c) After the nucleation, the halogen ion concentration of the emulsion thus obtained is decreased by ultrafiltration (e.g., as described in Japanese Patent Publication No. 43727/84).

(d) $AgNO_3$ is added to the emulsion thus obtained at a rate such that new nuclei are no longer produced.

(iv) After the nucleation, the gelatin concentration is properly adjusted. The reaction solution is then heated. An aqueous solution of $AgNO_3$ is added to the reaction solution while the reaction solution is ripened. In this case, the addition of an aqueous solution of $AgNO_3$ saves to both neutralize excess $Br^-$ ions used for the nucleation to adjust the pBr value for the subsequent growth step and facilitate efficient ripenin. The rate at which $AgNO_3$ is added to the solution is in the range of from 0.05 to 5 g/min., preferably from 0.1 to 2 g/min., when 1 g of $AgNO_3$ is used for the nucleation.

The low temperature saturation growth used in the processes (iii) and (iv) simultaneously causes so-called Ostwald ripening and slow grain growth, enabling effective ripening.

Preferred conditions under which the ripening process described in the above processes (i) to (iv) is effected will the described below.

The ripening temperature is in the range of from 40° to 80° C., Preferably from 50° to 80° C., The gelatin concentration is in the range of from 0.05 to 10% by weight, preferably from 1.0 to 5.0% by weight. In the 1st ripening step, a so-called silver halide solvent is not used, because such a silver hadlide solvent causes an increase in the rate of growth of finely divided grains other than fine tabular grain nuclei (particularly octahedron and single twin grains), leaving grains other than tabular grains present in the emulsion. The pBr value is in the range of from 1.2 to 2.5, preferably from 1.3 to 2.2.

In the process (iv), however, the pBr value increases from the value obtained shortly after the nucleation (1.0 to 2.5) as $AgNO_3$ is added.

Thus, once subjected to the 1st ripening process, tabular grain nuclei can be obtained. The tabular grain nuclei thus obtained mostly occur in the thickness of 0.1 μm or less, and constitute the central zone of tabular grains which will be produced after the subsequent growth process. It is therefore necessary, as already described, that the central portion having a higher solubility reach to parallel opposing major face surfaces of tabular grains thus produced or 0.002 μm to 0 μm, particularly 0.01 μm to 0 μm from both the major face surfaces. In order to fulfill this requirement, the thickness of these tabular grain nuclei need to be increased by the following 2nd ripening.

(3) 2nd ripening

In order to increase the thickness of the thin tabular grain nuclei thus obtained in the 1st ripening process, a silver halide solvent is added to the emulsion after the completion of the 1st ripening process so that another ripening is effected to increase the thickness of the tabular grain nuclei. The concentration of the silver hadlide solvent is preferably in the range of from 0 to $1.5\times10^{-1}$ mol/1. Preferred types of silver halide solvents can be selected as described later. Since Ostwald ripening proceeds slowly at a low temperature, it should be effected at a temperature of from 40° to 80° C., preferably from 50° to 80° C. from a practical viewpoint. The pBr value is generally in the range of from 1.2 to 6.0. However, the more the pBr value is, the more efficient is the incease in the thickness of the grains. Therefore, the pBr value is preferably in the range of from 2.5 from 6.0. The thickness of the tabular grain nuclues can be varied by properly adjusting the conditions for the 2nd ripening process. The 2nd ripening prosess may be optionally continued until the grain nuclui are spherically shaped. The tabular grain nucleus do not lose the twinning faces present inside, even if they are spherically shaped by physical ripening. Continuing growth produces lateral growth alone. Thus, the tabular grains of the present invention can the achieved. The tabular grain nuclei which have thus been adjusted to a proper thickness are then allowed to grow under the conditions described below.

(4) Growth

The pBr value is preferably kept at a range of from 1.8 to 3.5 for the first one third or more of the crystal growth period following the ripening process and then at a value of from 1.5 to 3.5 for the first one third or more of the rest of the crystal growth period. Furthermore, the rate at which silver ions and halogen ions are added to the emulsion during the crystal growth period is preferably such that the crystal growth rate reaches 20 to 100%, preferably 30 to 100% of the critical crystal growth rate. In this case, the rate at which silver ions and halogen ions are aided to the emulsion is increased as more crystals grow. This can be accomplished by a method such as described in Japanese Patent Publication Nos. 36890/73 and 1636/77, in which the rate at which an aqueous solution of silver salt and aqueous solution of halide are added to the emulsion (i.e., the flow rate) is increased with the concentration of the two solutions kept constant. Alternatively, the concentration of the two aqueous solutions may be increased with the flow rate thereof kept constant. Alternatively, the rate at which an emulsion of superfinely divided grains having a size of 0.10 μm or less is added to the emulsion may be increased. A combination of these methods may be optionally used in the present invention. The rate at which silver ions and halogen ions are added to the emulsion may be either intermittently or continuously increased.

The manner in which such an addition rate of silver ions and halogen ions is inceased can be determined by the concentration of colloid present therewith, the solubility of silver halide crystal grain, the degree of stirring in the reaction vessel, the size and concentration of crystals present at each step, the pH and pAg of aqueous solution in the reaction vessel, and the relationship between the final size and the size distribution of the desired crystal grains. However, it can be simply determined by a conventional experimental method.

Particularly, the upper limit of the rate at which silver ions halogen ions are added to the emulsion may be slightly lower than the value at which new crystal nucleus are produced. The upper limit can be determined by confirming the presence of new crystal nucleus in crystal specimens sampled from those produced at different flow rates in a practical system in a reaction vessel. This confirmation can be accomplished under a microscope.

For this process, Japanese Patent Application (OPI) No. 142329/80 can be referred to.

In the crystal growth period, the content of AgX to be accumulated on the growing nucleus is preferably between 3 mol% and the solid-solution limit concentration.

For the pH value of the solution, the type of the silver halide solvent and binder to be used, and the stirring process during the crystal growth period, Japanese Patent Application (OPI) No. 142329/80 can be referred to. These conditions are also described below.

In the tabular grains thus prepared, the solubility of the central portion thereof is higher than that of the surrounding portion thereof. Furthermore, the portion constitutiong the central portion reaches to the major face surfaces of the tabular grains or the very proximity thereof (i.e., 0.002 μm to 0 μm, particularly 0.01 μm to 0 μm from both the major face surfaces). The tabular silver halide grain is then processed with a silver halide solvent so that the central portion thereof is dissolved to leave an indentation or space therein.

Examples of a suitable silver halide solvent which may be used in the present invention include thiocyanate, ammonia, thioether, and thiourea.

Specific examples of such silver halide solvents include thiocyanates (as described in U.S. Pat. Nos. 2,222,264, 2,448,534, and 3,320,069), ammonia, thioether compounds (as described in U.S. Pat. Nos. 3,271,157, 3,574,628, 3,704,130, 4,297,439, and 4,276,347), thione compounds (as described in Japanese Patent Application (OPI) Nos. 144319/78, 82408/78, and 77737/80), amine compounds (as described in Japanese Patent Application (OPI) No. 100717/79), thiourea derivatives (as described in Japanese Patent Application (OPI) No. 2982/80), imidazoles (as described in Japanese Patent Application (OPI) No. 100717/79), and substituted mercaptotetrazole (as described in Japanese Patent Application (OPI) No. 202531/82). In accordance with the present invention, tabular silver halide grains in which the solubility in a silver halide solvent is higher in the center than in the surrounding portion are processed with a silver halide solvent so that an indentation or space is formed in the center of the major face of the tabular grains. This can be accomplished by adding a silver halide solvent to a silver halide emulsion containing such tabular silver halide grains, and then allowing the silver halide solvent to act on the central portion of the tabular grains under a condition selected such that :o more nucleation or physical ripening takes place. The processing temperature is in the range of from 40° to 80° C., preferably from 50° to 80° C.

The amount of the silver halide solvent to be used depends on the type thereof employed and preferably ranges from $5\times10^{-3}$ mol/mol-Ag to 1 mol/mol-Ag. If this solvent processing is effected shortly after the formation of grains, some part of the silver halide solvent used in the second ripening step during the formation of grains remains, which is also effective for the final solvent processing step. However, the amount of the solvent required for the final solvent processing step is much greater than that required for the second ripening during the formation of grains. In most cases, the silver halide solvent is further added after the formation of grains. If the emulsion is physically ripened after the formation of grains followed by rinse, the silver halide solvent is further needed. The time required for the solvent processing depends on the processing temperature, and preferably ranges from 5 to 120 minutes.

The pBr value during the processing is in the range of 1.2 to 5.0. The crystal habit of the indentation thus produced is determined by th<pBr value. Therefore, the pBr value is important. If a relatively low pBr value (e.g., 3.0 to 5.0) is selected, a trigonal pyramid-shaped indentation is formed in the center of the (1 0 0) face. Therefore, this condition makes it possible to introduce the (1 0 0) face in the central portion of the major surface face of tabular silver halide grain consisting of a (1 1 1) face. If the pBr is as low as 1 to 3, the indentation thus formed is in the tabular form of a triangular or hexagonal (occasionally a circular tabular form). This shows that the indentation thus formed consists of a (1 1 1) face. Thus, the selection of proper conditions makes it possible to introduce a second new crystal face into a tabular grain crystal consisting of a (1 1 1) major face. In this processing, if the surrounding halogen composition having a higher iodide density has previously adsorbed a substance which is more easily adsorbed by the surrounding portion (e.g., a sensitizing dye), the silver halide solvent acts on only the central portion of the major face, making it possible to form an indentation in the central portion of the major face with great efficiency. The sensitizing dye can serve both as a site director and a color sensitizing dye. As such a site director there may be used a fog inhibitor or stabilizer.

The present invention has been described with reference to a process for preparation of tabular grains in which the central portion comprises silver bromide or silver iodobromide having a small iodide content. The present invention will be discribed hereinafter with reference to a process for the preparation of tabular grains in which the central portion comprises silver chloride or silver chlorobromide. The preparation of silver chloride tabular grains can be accomplished by any suitable method, for example, that described in Japanese Patent Application (OPI) No. 108525/83, and *Photographic Science Symposium: Trino,* 1963, pp. 52–53. A process for the preparation of silver chlorobromide tabular grains having a high bromide content is disclosed in Japanese Patent Application (OPI) No. 111936/83.

These methods are used to form tabular grain nuclei of silver chloride or silver chlorobromide having a higher solubility. After the formation of tabular grain nuclei having a high silver chloride content, a large number of finely divided grains (particularly, cubic, octahedron, and single twin grains) are present besides fine tabular grain nuclei as in the case of silver bromide. Accordingly, a first ripening step is needed to dissolve and eliminate such finely divided grains other than tabular grain nuclei. In this case, too, the first ripening step is effected by an Ostwald ripening process at a temperature of from 40° to 80° C. and a pCl of from 0.3 to 1.4, without any silver halide solvent. Once tabular nuclei having a high silver chloride content are obtained, a second ripening is effected. That is, a silver halide solvent is added to the emulsion, and the emulsion is then physically ripened at a temperature of from 40° to 80° C. to obtain thick tabular glain nucleus or spherical nucleus. Then, a halogen cpomposition having a lower solubility than the nuclei is used to allow the nuclei grow to obtain a tabular grain emulsion. The growth process can be effected in accordande with the previously described method. The pCl value is preferably in the range of from 0 to 3.

In the tabular grains thus obtained, the solubility of the central portion is higher than that of the surrounding portion. The portion constituting the central portion reaches both the major face surfaces of the tabular grain or the proximity thereof. The tabular grains are then processed with a silver halide solvent to dissolve the central portion thereof so that an indentation or space is formed therein. The outline of this processing can be accomplished by the previously described method. The pCl value during the processing step is preferably in the range of from 0 to 5.

The CE-grains thus obtained have an indentation or space in the center of major faces consisting of opposing parallel (1 1 1) faces constituting the tabular silver halide grains. As already described, this specific point serves as a site for production of chemically-sensitized nucleus, that is, a site for formation of latent images.

Alternatively, guest grains of various halogen compositions may be epitaxially grown with CE-grains of the present invention as host grains. In this case, the guest epitaxy is produced in only one site in the center of the CE-grains. Thus, tabular epitaxial grains which are ideal for integration of latent image sites can be obtained. For epitaxial growth of the guest grains, Japanese Patent Application (OPI) Nos. 108526/83, and 133540/82 can be referred to.

Even after the CE-grains have been chemically sensitized, silver halide can be selectively allowed to grow twice in the central portion thereof. This enables the selective formation of light-sensitive nuclei as internal light-sensitive nuclei in the central portion of the tabular grains.

In general, the internal latent image type silver halide grains have an advantage over the surface latent image type silver halide grains in the following respects: (i) A silver halide crystal grain has a spatial electric charge layer formed therein. Electrons produced by adsorption of light flow into the inside of the grain while positive holes flow toward the surface thereof. Accordingly, if a latent image site (electron trap site), that is, the light-sensitive nucleus, has previously been provided inside the grain, re-combination can be prevented, enabling a highly efficient formation of latent images. Thus, a high quantum sensitivity can be realized.

(ii) Since the light-sensitive nuclei are present inside the grain, they are not subject to effects of water content or oxygen, thus providing an excellent preservability.

(iii) Since latent images formed by exposure to light, are also present inside the grain, they are not subject to effects of water content or oxygen, providing a very high stability in latent images.

(iv) If the emulsion is color-sensitized with a sensitizing dye adsorbed by the surface of the emulsion grains, a light adsorption site (a sensitizing dye on the surface) and a latent image site (a light-sensitive nucleus inside the grain) are separated from each other. This inhibits the re-combination of dye holes with electrons and hence, the inherent desensitization in color sensitization. Thus, a high color-sensitized sensitivity can be realized.

Japanese Patent Application No. 299155/86 describes a monodispersed hexagonal tabular grains type internal latant image type silver halide grains. In accordance with the process described in this reference, after the formation of tabular grains are followed by a chemical sinsitization thereof, the growth of grains is allowed to proceed to an excess saturation degree, in order to obtain a monodispersed internal latent image type tabular silver halide tabular grains. In this case, since the grains thus obtained are tabular, (i.e., thinner in the direction perpendicular to the major face thereof (that is, shell thickness)), the latent image sites are ofton too close to the surface thereof. In the present invention, it is made possible to form a new shell in the direction perpendicular to the central portion of the (1 1 1) major face of the tabular silver halide grain. Thus, the internal latent image sites can be positioned deeper from the surface of the grain. Furthermore, since the shell formation is limited to the central portion of the major face, no more shells are formed in portions other than the central portion of the major face. Accordingly, it is possible to provide internal latent image type grains without changing the original shape of the tabular grains. It goes without saying that the present grains can realize a higher sensitivity, because the number of sites for the formation of latent images (i.e., center of major face) is limited as described above.

In the present invention, the process of formation or physical ripening of silver halide grains may be effected in the presence of a cadmium salt, zinc salt, lead salt, thallium salt, iridium salt or complex salt thereof, rhodium salt or complex salt thereof, iron salt or complex salt thereof, or the like.

As a dispersant for the present photographic emulsion (i.e., a binder or protective colloid) there may be advantageously used the above-described gelatin. Other hydrophilic colloids may be used.

Specific examples of dispersants which may be used in the present invention include those described in *Research Disclosure* (RD No. 17643) Dec. 1978), Item IX.

For the purpose of inhibiting fog during the preparation, storage, or photographic processing of the light-sensitive material, or for stabilizing the photographic properties of the light-sensitive material, the present photographic emulsion may contain various compounds known as fog inhibitors or stabilizers.

For the purpose of improving the sensitivity and contrast of the light-sensitive material or accelerating the development thereof, the photographic emulsion layer in the light-sensitive material prepared in accordance with the present invention may contain a polyalkylene oxide or an ether, ester or amine derivative thereof, a thioether compound, a thiomorpholine, a quaternary ammonium salt compound, a urethane derivative, a urea derivative, an imidazole derivative, a 3-pyrazolidone, or the like.

Examples of sensitizing dyes which may be used in the present invention include those described in *Research Disclosure,* (RD No. 17643), Item IV, page 23 (Dec. 1978).

These sensitizing dyes may be present at any step in the process of preparation of the photographic emulsion or any step between after preparation and immediately before the coating thereof. Examples of the former steps include the formation, physical ripening and chemical ripening of silver halide grains.

The present silver halide emulsion may be optionally provided on a support in one or more layers (e.g. two or three layers) together with other emulsions. The present silver halide emulsion may be provided not only on one surface of the support but also on both surfaces thereof. Alternatively, the present silver halide emulsion may be multi-layered with different sensitivities.

The present silver halide emulsion can be used for silver halide black-and-white photographic materials (such as X-ray material, lith type light-sensitive material, and black-and-white negative film for photographing purposes), and color photographic light-sensitive materials (such as color negative film, color reversal film, and color paper). The present silver halide emulsion can also be used for diffusion transfer light-sensitive materials (such as color diffusion transfer elements and silver salt diffusion transfer elements), and black-and-white or color heat-developable light-sensitive materials. For materials to be used for such color diffusion transfer light-sensitive materials and usage thereof, *Research Disclosure* (RD No. 15162) (Nov. 1976) can be referred to.

For the rinsing and chemical sensitization of the present emulsion, as well as the fog inhibitors, dispersants, stabilizers, hadeners, dimensional stability improvers, anti-static agents, coating aids, dyes, and color couplers to be used for the present emulsion, the usage thereof, and the process for adhesion inhibition and improvement in photographic properties (e.g. development acceleration, addition to contrast, and sensitization), *Research Disclosure,* (RD No. 17643) (Dec. 1978) and (RD no. 18716) (Nov. 1979), and Japanese Patent Application (OPI) Nos. 113926/83, 113927/83, 113928/83, and 90342/84 can be referred to.

The places where such a description is found in the above described issues of *Research Disclosure* are summarized in the following table.

| Additives | RD No. 17643 | RD No. 18716 |
|---|---|---|
| 1. Chemical sensitizer | Page 23 | Right column on page 648 |
| 2. Sensitivity improver | | Right column on page 648 |
| 3. Spectral sensitizer, Supersensitizer | pp. 23-24 | Right column on page 648-right column on page 649 |
| 4. Brightening agent | page 24 | |
| 5. Fog inhibitor, Stabilizer | pp. 24-25 | Right column on page 649 |
| 6. Light absorber, Filter dye, Ultraviolet absorber | pp. 25-26 | Right column on page 649-left column on page 650 |
| 7. Stain inhibitor | Right column on page 25 | Left column to right column on page 650 |
| 8. Dye image stabilizer | page 25 | |
| 9. Film hardener | Page 26 | Left column on page 651 |
| 10. Binder | Page 26 | Left column on page 651 |
| 11. Plasticizer, Lubricant | Page 27 | Right column on Page 650 |
| 12. Coating aid, Surface active agent | pp. 26-27 | Right column on Page 650 |
| 13. Antistatic agent | page 27 | Right column on Page 650 |
| 14. Color coupler | Page 28 | pp. 647-648 |

Among these additives, as chemical sensitizers there may be used active gelatin, Such as described in T. H. James, *The Photographic Process,* 4th Ed., Macmillan, 1977, pp. 67-76. The chemical sensitization can also be accomplished by using sulfur, selenium, tellurium, gold, platinum, palladium, iridium, or a combination thereof, at a pAg of 5 to 10, a pH 5 to 8, and a temperature of 30° to 80° C. such as described in *Research Disclosure* (RD No. 12008) (April, 1974) and (RD No. 1352) (June, 1975), U.S. Pat. Nos. 2,642,361, 3,297,446, 3,772,032, 3,857,711, 3,901,714, 4,266,018, and 3,904,415, and British Patent No. 1,315,755. The chemical sensitization can be optimally effected in the presence of a gold compound and a thiocyanate compound, a sulfur-containing compound (as described in U.S. Pat. Nos. 3,857,711, 4,266,018, and 4,054,457), or a sulfur-containing compound (such as hypo(sodium thiosulfate), thiourea compound, and rhodanine compoud). The chemical sensitization may also be effected in the presence of a chemical sensitization aid. As such a chemical sensitization aid there may be used a chemical sensitization aid which is known to inhibit fog and improve sensitivity in the process of chemical sensitization. Examples of such chemical sensitization aids are described in U.S. Pat. Nos. 2,131,038, 3,411,914, and 3,554,757, Japanese Patent Application (OPI) No. 126526/83, and Duffin, *Chemistry of Photographic Emulsion,* pp. 138–143. In addition to, or instead of, the chemical sensitization, a reduction sensitization may be effected with hydrogen (as described in U.S. Pat. Nos. 3,891,446, and 3,984,249), or a reducing agent such as stannous chloride, thiourea dioxide, and polyamine (as described in U.S. Pat. Nos. 2,518,698, 2,743,182, and 2,743,183), or may be effected by a processing at a low pAg (e.g., lower than 5) and/or high pH (e.g., higher than 8).

The spectral sensitization property can be improved by a chemical sensitization process, such as described in U.S. Pat. Nos. 3,917,485, and 3,966,476.

Examples of fog inhibitors and stabilizers which may be used in the present invention include many compouds known as fog inhibitors and stabilizers, such as azoles (e.g., benzothiazolium salt, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, and mercaptotetrazoles (particularly, 1-phenyl-5-mercaptotetrazole)); mercaptopyrimidines; mercaptotriazines; thioketo compounds (e.g., oxadrinthione); azaindenes (e.g., triazaindenes, tetraazaindenes (particularly, 4-hydroxy-substituted (1,3,3a,7) tetraazaindenes, and pentaazaindenes)); benzenethiosulfonic acid; benzenesulfinic acid; and benzenesulfonic acid amide.

Typical examples of yellow couplers which can be used in the present invention include hydrophobic acylacetamide couplers containing ballast groups. Specific examples of such couplers are described in U.S. Pat. Nos. 2,407,210, 2,875,057, and 3,265.506. In the present invention, a two-equivalent yellow coupler may be preferably used. Typical examples of such two-equivalent yellow couplers include oxygen atom-releasing type yellow couplers (as described in U.S. Pat. Nos. 3,408,194, 3,447,928, 3,933,501, and 4,022,620), and nitrogen atom-relaeasing type yellow couplers (as described in Japanese Patent Publication No. 10739/83, U.S. Pat. Nos. 4,401,752, and 4,326,024, *Reseach Disclosure* (RD No. 18053) (April, 1979), British Patent No. 1,425,020, and West German Patent Application (OLS) Nos. 2,219,917, 2,261,361, 2,329,587, 2,433,812). α-Pivaloylacetanilide couplers are excellent in fastness of color forming dye, espesially to light. On the other hand, α-benzoylacetanilide couplers can provide a high color density.

Examples of magenta couplers which can be used in the present invention include ballast group-containing hydrophobic indazolone or cyanoacetyl, preferably 5-pyrazolone or pyrazoloazole couplers. As such 5-pyrazolone couplers, there may be preferably used a 5-pyrazolone coupler having the 3-position substituded by an arylamino group or an acylamino group in the light of color hue of the color forming dye the color density. Typical examples of such a 5-pyrazolone coupler are described in U.S. Pat. Nos. 2,311,082, 2,343,703, 2,600,788, 2,908,573, 3,062,653, 3,152,896, and 3,936,015. Particularly preferred examples of coupling-off groups for the two-equivalent 5-pyrazolone couplers include nitrogen atom-releasing groups (as described in U.S, Pat. No. 4,310,619), and arylthio groups (as described in U.S. Pat. No. 4,351,897). Ballast group-containing 5-pyrazolone couplers (as described in European Patent No. 73,636) can provide a high color density. Examples of pyrazoloazole couplers include pyrazolobenzimidazoles, such as described in U.S. Pat. No. 3,369,879. Preferred examples of such pyrazoloazole coplers include pyrazolo [5,1-c][1,2,4]triazoles (as described in U.S. Pat. No. 3,725,067), pyrazolotetrazoles (as described in *Reseach Disclosure* (RD No. 24220) (June, 1984) and Japanese Patent Application (OPI) No. 33552/85), and pyrazolopyrazoles (as described in *Reseach Disclosure* (RD No. 24230) (June, 1984) and Japanese Patent Application (OPI) No. 43659/85). With regard to side absorption of yellow light by the color forming dye and fastness of the color forming dye to light, imidazo[1,2-b]pyrazoles, such as described in U.S. Pat. No. 4,500,630, may be preferably used. Pyrazolo [1,5-b][1,2,4]triazole, such as described in U.S. Pat. No. 4,540,654, may be particularly preferably used.

Examples of cyan couplers which may be used in the present invention include hydrophobic nondiffusible naphthol and phenol coplers. Typical examples of such couplers include naphthol conplers such as described in U.S. Pat. No. 2,474,293. Preferred examples of such couplers include oxygen atom-releasing type two-equivalent naphthol couplers, such as described in U.S. Pat. Nos. 4,052,212, 4,146.396, 4,228,233, and 4,296,200. Specific examples of phenol couplers which may be used in the present invention are described in U.S. Pat. Nos. 2,369,929, 2,801,171, 2,772,162, and 2,895,826.

Cyan couples having fastness to heat and moisture may be preferably used in the present invention. Typical examples of such cyan couplers include phenol cyan couplers containing ethyl groups or higher alkyl groups in meta-position of phenol nucleus (as describedd in U.S. Pat. No. 3,772,002), 2,5-diacylamino-substituted phenol couplers (as described in U.S. Pat. Nos. 2,772,162, 3,758,308, 4,126,396, 4,334,011, and 4,327,173, West German Patent Application (OLS) No. 3,329,729, and European Patent No. 121,365), phenol coupleras containing phenylureido group in the 2-position and acylamino group in the 5-position (as described in U.S. Pat. Nos. 3,446,622, 4,333,999, 4,451,559, and 4,427,767), and 5-aminonaphthol couplers (as described in European Patent No. 161,626A).

In order to eliminate undesired absorption by a color forming dye, a colored coupler may preferably used in combination for a color light-sensitive material for photographing purposes, in order to provide a masking effect. Typical examples of such a colored coupler include yellow-colored magenta couplers (as described in U.S. Pat. No. 4,163,670, and Japanese Patent Publication No. 39413/82), and magenta-colored cyan couplers (as described in U.S. Pat. Nos. 4,004,929, and 4,138,258, and British Patent No. 1,146,368). Other examples of colored couplers are described in *Research Disclosure* (RD No. 17643), VII-G.

A coupler providing a color forming dye having a proper diffusivity can be used i: combination with the above-noted color couplers to improve graininess. Specific examples of such couplers are described in U.S. Pat. No. 4,366,237 and British Patent No. 2,125,570 for magenta couplers, and European Patent No. 96,570 and West German Patent Application (OLS) No. 3,234,533 for yellow, magenta or cyan couplers.

The dye forming couplers and the above described special couplers may form a dimer or higher polymer. Typical examples of polymerized dye forming couplers are described in U.S. Pat. Nos. 3,451,820 and 4,080,211. Specific examples of polymerized magenta couplers are described in British Patent No. 2,102,173, and U.S. Pat. No. 4,367,282.

Couplers which release a photographically useful residual group upon coupling may be preferably used in the present invention. As DIR corplers which release a development inhibitor there may be preferably used couplers as described in patents cited in *Research Disclosure* (RD No. 17643), VII-F.

Preferred examples of couplers which may be used in combination in the present invention include developing solution deactivation type couplers (as described in Japanese Patent Application (OPI) No. 151944/82), timing type couplers (as described in U.S. Pat. No. 4,248,962, and Japanese Patent Application (OPI No. 154234/82), and reaction type couplers (as described in Japanese Patent Application (OPI) No. 184248/85). Particularly preferred examples of couplers which may be used in combination in the present invention incude developing solution deactivation type DIR couplers (as described in Japanese Patent Application (OPI) Nos. 151944/82, 217932/83, 218644/85, 225156/85, and 233650/H5), and reaction type DIR couplers (as described in Japanese Patent Application (OPI) No. 184248/85).

The present light-sensitive material may comprise a coupler which imagewise releases a nucleating agent or development accelerator, or a precursor thereof, upon development. Specific examples of such a compound are described in British Patent Nos. 2,097,140, and 2,131,188. A coupler which releases a nucleating agent which serves to adsorb silver halide may be particularly preferably used in the present invention. Specific examples of such couplers are described in Japanese Patent Application (OPI) Nos. 157638/84, and 170840/84.

The present light-sensitive material may an inorganic or organic film hardener in a photographic light-sesitive layer or any hydrophilic colloidal layer constituting a back layer. Specific examples of such film hardeners include chromium salts, aldehydes (such as formaldehyde, glyoxazal, and glutaraldehyde), and N-methylol compounds (such as dimethylol urea). Active halides (such as 2,4-dichloro-6-hydroxy-1,3,5-triazine), active vinyl compouds (such as 1,3-bisvinylsulfonyl-2-propanol, 1,2-bisvinylsulfonylacetamideethane), and vinyl polymers containing vinylsulfonyl groups in the side chains thereof, can rapidly harder a hydrophilic colloid such as gelatin to provide stable photographic properties and may be preferably used in the present invention. N-carbamoylpyridinium salts and haloamidinium salts are excellent in hardening speed.

Preferred examples of anti-static agent incude fluorine-containig surface active agent (such as potassium perfluorooctanesulfonate, sodium salt of N-propyl-N-perfluorooctanesulfonylglycine, sodium N-propyl-N-perfluorooctanesulfonyllaminoethyloxypoly(n=3)oxyethylenebutanesulfonate, N-perfluorooctanesulfonyl-N',N',N'-trimethylammoniodiaminolpropane chloride, and N-perfluorodecanoylaminopropyl-N,N'-dimethyl-N'-carboxybentaine), nonionic surface active agents (such as described in Japanese Patent Application (OPI) Nos. 80848/85, 112144/86, 172343/87, and 173459/87), nitrates of alkaline metal, electrically-conductive tin oxide, zinc oxide, vanadium pentaoxide, and composite oxides comprising these oxides doped with antimony or the like. With regard to these anti-static agents, the descriptions in Japanese Patent Application (OPI) No. 288838/87, and Japanese Patent Application (OPI) Nos. 8543/82, 14834/83, 220345/85, and 282841/86, can be referred to.

The process for the evelopment of the photographic light-sensitive material comprising the present emulsion is not specifically limited. For example, the description in *Research Disclosure* (RD No. 17643) and (RD No. 18716) can be referred to.

The present silver halide photographic emulsion will be further illustrated in the following examples, but the present invention shoud not be construed as being limited thereto.

All amounts not specified are by weght.

EXAMPLE 1

Matrix grain emulsion 1-A 30 cc of 0.5 M silver nitrate solution and 30 cc of 0.5 M potassium bromide sulution added to 2 l of a 0.5 wt% gelatin solution containing 0.07 M of potassium bromide, by a double jet process with stirring in 1 minute, while the gelatin solution was kept at a temperature of 30° C. After the addition was completed, the admixture was heated to a temperature of 75° C. Then, 30 g of gelatin was added to the reaction mixture.

135 cc of 0.5 M silver nitrate solution was then added to the reaction mixture in 20 minutes. The pBr value of the solution was 2.6. 1 g of 3,6-dithioctane-1,8-diol was then added to the reaction mixture. The reaction mixture was then ripened for 10 minutes. 150 g of silver nitrate and a potassium bromide solution cotaining 10 mol% of potassium iodide were then added in equimolecular amounts to the reaction mixture in accelerated flow rates (i.e., the flow rate at the end was 15 times that at the beginnig). The pBr value of the solution was kept at 1.6 while the addition was conducted. The emulsion was then cooled. The emulsion was washed with an ordinary flocculation process. 50 g of gelatin was then added to the emulsion. The emulsion was adjusted to a pH value of 6.5 and a pAg value of 8.2. Hexagonal tabular grains accounted for 80% of the emulsion grains thus obtained. The emulsion had a fluctuation coefficient of 19%. The emulsion grains had an average grain diameter of 1.8 μm, as calculated in terms of the diameter of the projected area, and had an average thickness of 0.4 μm.

Emulsion 1-B: CE-grain 300 cc of distilled water was added to 500 g of Emulsion 1-A thus obtained (corresponding to 0.4 mol Ag). The reaction mixture was then heated to a temperature of 75° C. Then, 30 cc of 2 M potassium thiocyanate solution was added to the reaction mixture. The reaction mixture was then physically ripened for 30 minutes. The emulsion was then cooled. The emulsion was washed in an ordinary flocculation process. Next, 35 g of gelatin dissolved in the emulsion. The emulsion was then adjusted to a pH value of 6.5 and a pAg of 8.7. The tabular grains thus obtained had an indentation in the center of its major face. It was thus found that CE-grains were obtained. CE-grains accounted for about 62% of the tabular grains thus obtained. (See FIG. 1)

Emulsion 1-C: CE-grain 300 cc of distilled water was added to 500 g of Emulsion 1-A (corresponding to 0.4 mol Ag). The reaction mixture was then heated to a temperature of 75° C. 20 cc of 5% 3,6-dithioctane-1,8-diol was then added to the reaction mixture. The reaction mixture was then physically ripened for 30 minutes. The emulsion was cooled. The emulsion was washed in an ordinary flocculation process. 35 g of gelatin was dissolved in the emulsion. The emulsion was adjusted to a pH value of 6.5 and a pAg of 8.7. The tabular grains thus obtained had an indentation in the center of its major face. Thus, CE-grains were obtained. CE-grains accounted for about 69% of the tubular grains thus obtained.

Figure 2:
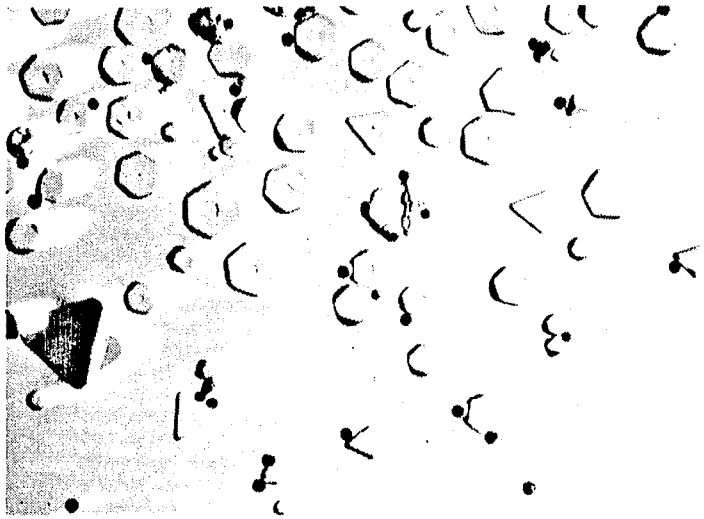

300 cc of distilled water was added to 500 g of Emulsion 1-A (corresponding to 0.4 mol Ag}. The reaction mixture was then heated to a temperature of 75° C. A sensitizing dye represented by the formula set forth below (Setnsitizing Dye I) was added to the reaction mixuture in an amount of 300 mg/mol-Ag. After 10 minutes had passed, 30 cc of 2 M potassium thiocyanate solution was added to the reaction mixture. The reaction mixture was then ripened for 20 minutes. The emulsion thus obtained was cooled. The emlusion was washed in an ordinary flocculation process. 35 g of gelatin was added to the emulsion. The gelatin was dissolved in the emulsion. The emulsion was adjusted to a pH of 6.5 and a pAg of 8.7. The tabular grains thus obtained had a definite indentation in the center of its (1 1 1) face surface. Thus, CE-grains were obtained. This prevents the edge and corner portions of the tabular grains from being rounded. CE-grains accounted for about 78% of the tabular grains thus obtained. (See FIG. 2)

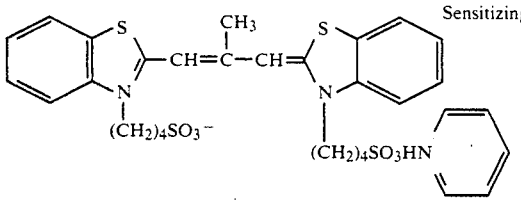

Sensitizing dye I

Sodium thiosulfate and potassium chloroaurate were added to these Emulsions A to D (Emulsion A had been adjusted to a pAg of 8.7). Emulsions A to D were optimally chemically sensitized. After the ripening was completed, 4-hydroxy-6-methyl-1,3,3a,7-tetrazaindene was added to the emulsions. These emulsions were coated onto a polyethylene terephthalate support in an amount of 3 g/m$^2$ as calculated in terms of silver. These samples were then exposed to blue light from a 2854° K tungsten light source through a 419 nm interference filter for 1/10 second, developed with the developing solution D-1 as described below, at a temperature of 20° C. for 4 minutes, fixed with a fixing solution F-1 as described below, washed with water, and then dried.

| Developing solution: D-1 | |
|---|---|
| 1-Phenyl-3-pyrazolidone | 0.5 g |

-continued

| | |
|---|---|
| Hydroquinone | 20.0 g |
| Disodium ethylenediaminetetraacetate | 2.0 g |
| Potassium sulfite | 60.0 g |
| Boric acid | 4.0 g |
| Potassium carbonate | 20.0 g |
| Sodium bromide | 5.0 g |
| Diethylene glycol | 30.0 g |
| Water to make | 1 l |
| pH adjusted to | 10.0 |
| Fixing solution: F-1 | |
| Ammonium thiosulfate | 200.0 g |
| Sodium sulfite (anhydrous) | 20.0 g |
| Boric acid | 8.0 g |
| Disodium ethylenediaminetetraacetate | 0.1 g |
| Aluminum sulfate | 15.0 g |
| Sulfuric acid | 2.0 g |
| Glacial acetic acid | 22.0 g |
| Water to make | 1 l |
| pH adjusted to | 4.2 |

The results of the sensitometry are shown in Table 1.

TABLE 1

| Emulsion | Relative sensitivity | Fog | Remarks |
|---|---|---|---|
| 1-A | 100 | 0.10 | Matrix grains (comparison) |
| 1-B | 205 | 0.10 | CE-grains (invention) |
| 1-C | 200 | 0.10 | CE-grains (") |
| 1-D | 195 | 0.10 | CE-grains (") |

The amount of sodium thiosulfate and potassium chloroaurate required for the optimum chemical sensitization are shown in Table 2.

TABLE 2

| Emulsion | Sodium thiosulfate | Potassium chloroaurate |
|---|---|---|
| 1-A | 1.0 mg | 1.0 mg |
| 1-B | 0.20 mg | 0.20 mg |
| 1-C | 0.15 mg | 0.15 mg |
| 1-D | 0.10 mg | 0.10 mg |

Table 2 shows that the amount of a sensitizer required for the optimum chemical sensitization of the present CE-grains is much less than that of the matrix grains because the portions to be chemically sensitized in the present CE-grains are specifically limited to the center of major face of tabular grains.

EXAMPLE 2

Matrix grain emulsion 2-A 150 cc of 2.00 M silver nitrate solution and 150 cc of 2.00 M potassium bromide solution were added to 1 l of 0.8 wt% gelatin solution containing 0.08 M potassium bromide with stirring in a double jet process while the latter was kept at a temperature of 30° C. After the addition was completed, the reaction mixture was heated to a temperature of 75° C. Next, 30 g of gelatin was added to the reaction mixture. The reaction mixture was physically ripened for 20 minutes. 1 g of 3,6-dithioctane-1,8-diol was added then to the reaction mixture.

After the addtion was completed, the reaction mixture was further ripened for 30 minutes. The grains (hereinafter referred to as "crystal species") thus formed were washed in an ordinary flocculation process. The crystal species were then adjusted to a pH of 5.0 and a pAg of 7.5 at a temperature of 40° C.

One tenth of the above described crystal species was dissolved in 1 of a solution containing 3 wt% gelatin. The solution was then maintained at a pBr value of 2.55 at a temperature of 75° C. 150 g of silver nitrate and a potassium bromide solution containing 8 mol% potassium iodide were added to the reaction mixture in acceletated flow rates (flow rate at the end was 19 times that at the beginning) in 60 minutes. The pBr value of the reaction mixture was kept at 2.55 while the addition was conducted.

The emulsion thus obtained was then cooled to a temperature of 35° C. The emulsion was the washed in an ordinary flocculation process. The emulsion was adjusted to a pH value of 6.5 and a pAg of 8.6 at a temperature of 40° C. The emulsion was then stored in a dark place. Hexagonal tabular grains accounted for 80% of the emulsion grains thus obtained. The emulsion had a fluctuation coefficient of 18% of the tubular grains. The emulsion had a fluctuation coefficient of 18%. The grains had an average diameter of 2.2 μm as calculated in terms of projected area and an average thickness of 0.3 μm.

Emulsion 2-B: CE-grains 300 cc of distillated water was added to 500 g of Emulsion 2-A thus obtained. The reaction mixture was then heated to a temperature of 70° C. 15 cc of 25% ammonia water was added to the reaction mixture. The reaction mixture was then physically ripened for 30 minutes. The emulsion thus obtained was cooled. The emulsion was then washed in an ordinary flocculation process. Then, 35 g of gelatin was dissolved in the emulsion. The emulsion was adjusted to a pH of 6.5 and a pAg of 8.7. The tabular grains thus obtained had an indentation in the center of its major face. This shows that CE-grains were obtained. CE-grains accounted for about 75% of the tabular grains thus obtained.

Emulsion 2-C: CE-grain 300 cc of destillated water was added to 500 g of Emulsion 2-A thus obtained. The reaction mixture was then heated to a temperature of 75° C. 30 cc of 1% 4-hydroxy-6-methyl-1,3,3a,7-tetrazaindene was added to the reaction mixture. After 10 minutes passed, 15 cc of 5% 3,6-dithioctane-1,8-diol was added to the reaction mixture. The reaction mixture was then physically ripened for 15 minutes. The emulsion thus obtained was then cooled. the emulsion was washed n an ordinary flocculation process. 35 g of gelatin was disslolved in the emulsion. The emulsion was adjusted to a pH value of 6.5 and a pAg of 8.7. The shape of the indentation on the major face of the tabular grains thus obtained was made definite by the use of 4-hydroxy-6-methyl-1,3,3a,7-tetrazaindene. CE-grains acounted for about 85% of the tabular grains thus obtained. The portions other than the center of the major face (apex and edge portions) were prevented from being dissolved.

Figure 3:
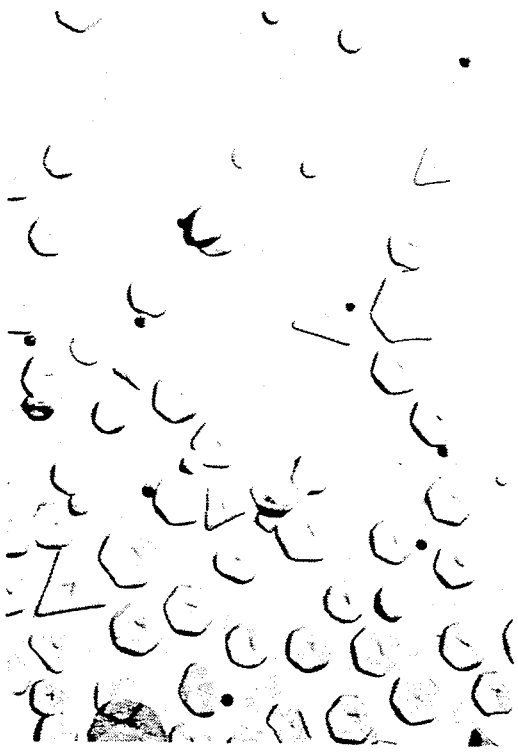

Emulsion 2-D: CE-grain 300 cc of distilled water was added to 500 g of Emulsion 2-A. The reaction mixture was heated to a temperature of 75° C. A sensitizing dye represented by the formula set forth below (Sensitizing Dye II) was added to the reaction mixture in an amount of 250 mg/mol-Ag. After 10 minutes passed, 15 cc of 5% 3,6-dithioctane-1,8-diol was added to the reaction mixture. The reaction mixture was then physically ripened for 20 minutes. The emulsion thus obtained was washed in an ordinary flocculation process. 35 g of gelatin was dessolved in the emulsion. The emulsion was adjusted to a pH value of 6.5 and a pAg of 8.7. About 90% of the tabular grains thus obtained were definite CE-grains. (See FIG. 3)

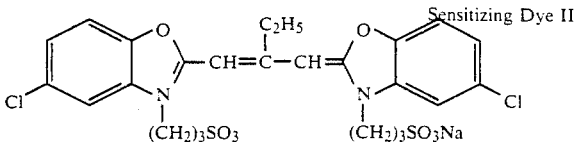

Sodium thiosulfate and potassium chloroaurate were then added to these Emulsions A to D. These Emulsions A to D were then optimally chemically sensitized. These emulsions were dissolved at temperature of 40° C. The above described sensitizing dye was added to Emulsions 2-A, 2-B, and 2-C in an amount of 250 mg/mol-Ag. 4-Hydroxy-6-methyl-1,3,3a,7-tetrazaindene was added to these emulsions. (For Emulsion 2-C, the added amount of 4-hydroxy-6-methyl-1,3,3a,7-tetrazaindene was adjusted so that the total added amount was equal to that for the other emulsions.) These emulsions were each coated onto a polyethylene terephthalate support in an amount of 2 g/m$^2$ as calculated in terms of silver. These emulsion samples were each exposed to light from a 5400 ° K light source through a filter which cut light having a wavelength shorter than 500 nm (minus blue exposure) for 1/10 second, developed with the developing solution D-1 described in Example 1, at a temperature of 20° C for 4 minutes, fixed with the above described fixing solution F-1, washsed with water, and dried.

The results of the sensitometry are shown in Table 3.

TABLE 3

| Emulsion | Relative sensitivity | Fog | Remarks |
|---|---|---|---|
| 2-A | 100 | 0.10 | Matrix grains (Comparison) |
| 2-B | 190 | 0.15 | CE-grains (invention) |
| 2-C | 205 | 0.12 | CE-grains (invention) |
| 2-D | 230 | 0.10 | CE-grains (invention) |

The amount of sodium thiosulfate and potassium cholroaurate reqired for the optimum chemical sensitization are shown in Table 4.

TABLE 4

| Emulsion | Sodium thiosulfate | Potassium cholroaurate |
|---|---|---|
| 2-A | 1.4 mg | 1.0 mg |
| 2-B | 0.3 mg | 0.2 mg |
| 2-C | 0.3 mg | 0.2 mg |
| 2-D | 0.2 mg | 0.15 mg |

Table 4 shows that the present CE-grains require a remarkably less amount of the sensitizer required for the optimum chemical sensitization than the matrix grains because the portions to be chemically sensitized in the present CE-grains are specifically limited to the center of major fsces of tabular grains.

EXAMPLE 3

Matrix grain emulsion 3-A 150 cc of 2.0 M silver nitrate solution and 150 cc of 2.0 M potassium bromide solution were added to 2 l of a 0.8 wt% gelatin solution containing 0.07 M potassium bromide with stirring in a double jet process while the latter was kept at a temperature of 30° C. After the addition was completed, the reaction mixture was heated to a temperature of 75° C. 50 g of gelatin was added to the reaction mixture. 67 cc of 1.0 M silver nitrate solution was added to the reaction mixture. 20 cc of 25% ammonia water was added to the reaction mixture. The reaction mixture was then physically ripened at a temperature of 75° C for 20 minutes. The ammonia was neutralized with glacial acetic acid. The reaction mixture was then washed in an ordinary flocculation process. The reaction mixture was adjusted to a pH value of 6.5 and a pAg value of 7.5 at a temperature of 40° C. One tenth of the emulsion containing the grains (hereinafter referred to as "crystal species") thus obtained was dissolved in 1.5 of a solution containing 5 wt% gelatin. The solution was kept at a pBr value of 1.5 and a temperature of 75° C. 150 g of silver nitrate and a potassium bromide solution containing 10 mol% potassium iodide were added to the solution in equimolecular amounts in accelerated flow rates (flow rate at the end was 15 times that at the beginning) in 80 minutes. The emulsion was then cooled. The emulsion was washed in an ordinary flocculation process. 50 g of gelatin was added to the emulsion. The emulsion was then adjusted at a pH value of 6.5 and a pAg value of 8.2. Hexagonal tabular grains accounted for 85% of the emulsion grains thus obtained. The emulsion grains had an average diameter of 2.2 μm as calculated in terms of projected area and an average thickness of 0.2 μm.

Emulsion 3-B: CE-grain 300 cc of distilled water was added to 500 g of Emulsion 3-A thus obtained (corresponding to 0.4 mol-Ag). The reaction mixture was heated to a temperature of 75° C. 210 mg of Sensitizing Dye I described above was added to the reaction mixture. After 15 minutes passed, 30 cc of 2 M potassium thiocyanate was added to the reaction mixture. The reaction mixture was then physically ripened for 15 minutes. The emulsion thus obtained was cooled. The emulsion was then washed in an ordinary flocculation process. 50 g of gelatin was added to the emulsion. The emulsion was adjusted to a pH value of 6.5 and a pAg value of 8.7. The grains thus obtained had a definite indentation in the center of its major fsces. Thus, CE-grains were obtained. CE-grains accounted for about 88% of the tabular grains thus obtained.

Emulsion 3-C: CE-grain 300 cc of distilled water was added to 500 g of Emulsion 3-A (corresponding to 0.4 mol-Ag). The reaction mixture was heated to a temperature of 75° C. 30 cc of 2 M potassium thiocyanate was added to the reaction mixture. The reaction mixture was then physically ripened for 20 minutes. The emulsion was cooled, and then washed. 50 g of gelatin was dissolved in the emulsion. The emulsion was adjusted to a pH value of 6.5 and a pAg value of 8.7 to obtain CE-grains. CE-grains accounted for about 78% of the tabular grains thus obtained.

Chemical Sensitization

Sodium thiosulfate and potassium chloroaurate were added to Emulsions 3-A to 3-C. These emulsions were then optimally sensitized. The sensitizing Dye I was used in the manner as described below. The added amount of sensitizing dye I in each emulsion was 210 mg/0.4 mol-Ag as in Emulsion 3-B.

| Sample | Emulsion | Time at which Sensitizing Dye I was added |
|---|---|---|
| I | 3-A | Before chemical sensitization |
| II | " | After completion of chemical sensitization |
| III | 3-C | Before chemical sensitization |
| IV | " | After completion of chemical sensitization |
| V | 3-B | — |

After the completion of the above chemical sensitization, 100 g of each of Emulsions A to E was dissolved at a temperature of 40° C. The undermentioned compounds (i) to (iii) were added to these emulsions in sequence with stirring.

| | |
|---|---|
| (i) 4-Hydroxy-6-methyl-1,3,3a,7-tetrazaindene (3%) | 2 cc |
| (ii) $C_{17}H_{35}-O-(CH_2CHO)_{25}-H$ (2%) | 2.2 cc |
| (iii) 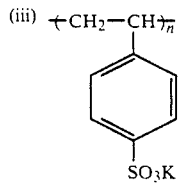 (2%) | 1.6 cc |

n = ca. 3000

Surface protective layer coating solutions were prepared by adding the following compounds (i) to (v) to these emulsions in sequence with stirring at a temperature of 40° C.

| | |
|---|---|
| (i) 14% aqueous solution of gelatin | 56.8 g |
| (ii) Finelly divided particles of plymethylmethacrylate (average particle size: 3.0 μm) | 3.9 g |
| (iii) Emulsion containing: Gelatin (10%) | 4.24 g |
| $NaO_3S-CH(CH_2COOCH_2CH(C_2H_5)C_4H_9)COOCH_2CH(C_2H_5)C_4H_9$ | 10.6 mg |
| 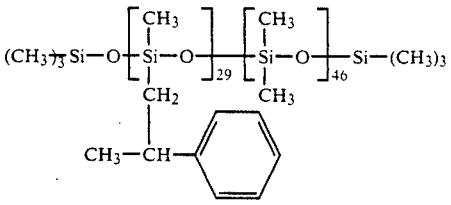 | 0.424 g |
| 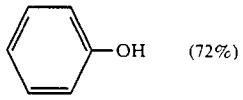 (72%) | 0.02 cc |
| (iv) $H_2O$ | 68.8 cc |

-continued (v) 3 cc

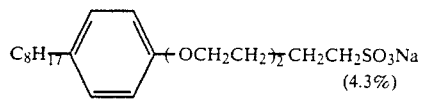

(4.3%)

The emulsion coating solutions and surface protective layer coating solutions thus obtained were coated onto a cellulose triacetate film by a simultaneous extrusion process in such a manner that the volumtic ratio upon the coating reached 103:45. The coated amount was 3.1 g/m$^2$ as calculated in terms of silver. These samples were exposed to light of 200 lux from a light source with a color temperature of 2,854° K. through an optical wedge for 1/10 second, developed with the developing solution D-2 described below at a temperature of 20° C for 7 minutes, fixed with a fixing solution F-1 described above, washed with water, and dried.

| Developing solution D-2 | |
|---|---|
| Methol | 2 g |
| Sodium sulfite | 100 g |
| Hydroquinone | 5 g |
| Borax.5$H_2O$ | 1.53 g |
| Water to make | 1 l |

The results of sensitometry are shown in Table 5.

TABLE 5

| Sample | Relative sensitivity | Fog | Remarks |
|---|---|---|---|
| I | 120 | 0.10 | Comparison |
| II | 100 | 0.09 | " |
| III | 200 | 0.10 | Present invention |
| IV | 180 | 0.1 | " |
| V | 240 | 0.09 | " |

Table 5 shows that the present CE-grain-containing emulsions have higher sensitivity than the other comparative emulsions.

EXAMPLE 4

Matrix grain emulsion 4-A 30 cc of 0.5 M silver nitrate solution and 30 cc of 0.5 M potassium bromide solution were added to 2 l of a 0.5 wt% gelatin solution containing 0.07 M potassium bromide with stirring in a double jet process in 1 minute while the latter was kept at a temperature of 30° C. The reaction mixture was heated to a temperature of 75° C. 30 g of gelatin was added to the reaction mixture. 135 cc of 0.5 M silver nitrate solution was added to the reaction mixture in 20 minutes. The pBr of the reaction mixture was 2.6. 1 g of 3,6-dithioctane-1,8-diol was added to the reaction mixture. The reaction mixture was then ripened for 10 minutes. 150 g of silver nitrate and a potassium bromide solution containing 4 mol% potassium iodide were added to the reaction mixture in equimolecular amounts in accelerated flow rates (flow rate at the end was 15 times that at the beginning) for 80 minutes. The pBr was kept at 1.6 during the addition. The emulsion thus obtained was cooled. The emulsion was then washed in an ordinary flocculation process. 50 g of gelatin was added to the emulsion. The emulsion was adjusted to a pH value of 6.5 and a pAg of 8.2. Hexagonal tabular grains accounted for 80% of the emulsion grains thus obtained. The emulsion grains had a fluctuation coefficient of 19%. The grains had an average diameter of 1.8 μm as calculated in terms of projected area and an average thickness of 0.4 μm.

Emulsion 4-B: CE-grain 300 cc of distilled water was added to 500 g of Emulsion 4-A thus obtained (corresponding to 0.4 mol-Ag). The reaction mixture was heated to a temperature of 75° C. 15 cc of 2 M potassium thiocyanate solution was added to the reaction mixture. The reaction mixture was physically ripened for 15 minutes. The emulsion thus obtained was then cooled. The emulsion was washed in an ordinary flocculation process. 35 g of gelation was dissolved in the emulsion. The emulsion was then adjusted to a pH value of 6.5 and a pAg value of 8.7. The grains thus obtained had a definite indentation in the center of its major face. Thus, CE-grains were obtained. CE-grains accounted for about 88% of the tabular grains thus obtained.

Emulsion 4-A was adjusted to a pAg value of 8.7. Emulsion 4-A thus processed and Emulsion 4-B thus obtained were then optimally chemically sensitized with sodium thiosulfate and potassium chloroaurate.

Multilayer color light-sensitive material san ples 101 and 102 were prepared by coating various of the undermentioned compositions on an undercoated cellulose triacetate film support. These samples contained Emulsions 4-A and 4-B in the 2nd green-sensitive layer.

| | |
|---|---|
| First layer: Antihalation layer | |
| Gelatin layer (dried film thickness: 2 μm) containing: | |
| Black-and-white colloidal silver | 0.25 g/m$^2$ |
| Ultraviolet absorber U-1 | 0.04 g/m$^2$ |
| Ultraviolet absorber U-2 | 0.1 g/m$^2$ |
| Ultraviolet absorber U-3 | 0.1 g/m$^2$ |
| High boiling point organic solvent O-1 | 0.1 cc/m$^2$ |
| Second layer: Intermediate layer | |
| Gelatin layer (dried film thickness: 1 μm) containing: | |
| Compound H-1 | 0.05 g/m$^2$ |
| High boiling point organic solvent O-2 | 0.05 cc/m$^2$ |
| Third layer: First red-sensitive emulsion layer | |
| Gelatin layer (dried film thickness: 1 μm) containing: | |
| Silver iodobromide emulsion spectrally sensitized with sensitizing dyes S-1 and S-2 (iodide content: 4.0 mol %; average grain size: 0.3 μm; monodispersed cubic grains) | 0.5 g/m$^2$ as silver |
| Coupler C-1 | 0.2 g/m$^2$ |
| Coupler C-2 | 0.05 g/m$^2$ |
| High boiling point organic solvent O-2 | 0.12 cc/m$^2$ |
| Fourth layer: Second red-sensitive emulsion layer | |
| Gelatin layer (dried film thickness: 2.5 μm) containing: | |
| Silver iodobromide emulsion spectrally sensitized with sensitizing dyes S-1 and S-2 (i.e., monodispersed cubic grains with an iodide content of 3.0 mol % and an average grain size of 0.6 μm) | 0.8 g/m$^2$ as silver |
| Coupler C-1 | 0.55 g/m$^2$ |
| Coupler C-2 | 0.14 g/m$^2$ |
| High boiling point organic solvent O-2 | 0.33 cc/m$^2$ |
| Fifth layer: Intermediate layer | |
| Gelatin layer (dried film thickness: 1 μm) containing: | |
| Compound H-1 | 0.1 g/m$^2$ |
| High boiling point organic solvent O-2 | 0.1 cc/m$^2$ |
| Sixth layer: First green-sensitive emulsion layer | |
| Gelatin layer (dried film thickness: 1 μm) containing: | |
| Silver iodobromide emulsion containing sensitizing dyes S-3 and S-4 (monodispersed cubic grains having an | 0.7 g/m$^2$ as silver |

-continued

| | |
|---|---|
| iodide content of 4.0 mol % and an average grain size of 0.3 μm) | |
| Coupler C-3 | 0.35 g/m² |
| High boiling point organic solvent O-2 | 0.26 cc/m² |
| Seventh layer: Second green-sensitive emulsion layer | |
| Gelatin layer (dried film thickness: 2.5 μm) containing: | |
| Silver iodobromide emulsion containing sensitizing dyes S-3 and S-4 (Emulsion 4-A or Emulsion 4-B) | 0.7 g/m² as silver |
| Coupler C-4 | 0.25 g/m² |
| High boiling point organic solvent O-2 | 0.05 cc/m² |
| Eighth layer: Intermediate layer | |
| Gelatin layer (dried film thickness: 1 μm) containing: | |
| Compound H-1 | 0.05 g/m² |
| High boiling point organic solvent O-2 | 0.1 cc/m² |
| Ninth layer: Yellow filter layer | |
| Gelatin layer (dried film thickness: 1 μm) containing: | |
| Yellow colloidal silver | 0.1 g/m² |
| Compound H-1 | 0.02 g/m² |
| Compound H-2 | 0.03 g/m² |
| High boiling point organic solvent O-2 | 0.04 cc/m² |
| Tenth layer: First blue-sensitive emulsion layer H | |
| Gelatin layer (dried film thickness: 1.5 μm) containing: | |
| Silver iodobromide emulsion containing a sensitizing dye S-5 (i.e., mono-dispersed cubic grains having an iodide content of 2.7 mol % and an average grain size of 0.25 μm) | 1.6 g/m² as silver |
| Coupler C-5 | 0.5 g/m² |
| High boiling point organic solvent O-2 | 0.1 cc/m² |
| Eleventh layer: Second blue-sensitive emulsion layer B | |
| Gelatin layer (dried film thickness: 3 μm) containing: | |
| Silver iodobromide emulsion containing a sensitizing dye S-5 (i.e., mono-dispersed cubic grains having an iodide content of 3 mol % and an average grain size of 0.7 μm) | 1.1 g/m² as silver |
| Coupler C-5 | 1.2 g/m² |
| High boiling point organic solvent O-2 | 0.23 cc/m² |
| Twelfth layer: First protective layer | |
| Gelatin layer (dried film thickness: 2 μm) containing: | |
| Ultraviolet absorber U-1 | 0.02 g/m² |
| Ultraviolet absorber U-2 | 0.03 g/m² |
| Ultraviolet absorber U-3 | 0.03 g/m² |
| Ultraviolet absorber U-4 | 0.29 g/m² |
| High boiling point organic solvent O-1 | 0.28 cc/m² |
| Thirteenth layer: Second protective layer | |
| Gelatin layer (dried film thickness: 0.8 μm) containing: | |
| Surface-fogged finely divided grains of silver iodobromide (iodide content: 1 mol %; average grain size: 0.06 μm) | 0.1 g/m² as silver |
| Particulate polymethylmethacrylate (average particle diameter 1.5 μm) | 0.6 g/m² |

Besides the above described compositions, a gelatin film hardener H-3 and a surface active agent were added to each layer.

The compounds used to prepare these samples are set forth below.

Samples 101 and 102 thus obtained were each exposed to white light through an optical wedge, and then subjected to the following development.

| Step | Processing steps Time (min.) | Temperature (°C.) |
|---|---|---|
| First development | 6 | 38 |

-continued

| Step | Processing steps Time (min.) | Temperature (°C.) |
|---|---|---|
| Rinse | 2 | " |
| Reversal | 2 | " |
| Color development | 6 | " |
| Adjustment | 2 | " |
| Bleaching | 6 | " |
| Fixing | 4 | " |
| Rinse | 4 | " |
| Stabilizing | 1 | Ordinally temperature |
| Drying | | |

The composition of processing solutions used were as follows:

| | |
|---|---|
| First developing solution | |
| Water | 700 ml |
| Pentasodium nitrilo-N,N,N-trimethylene phosphonate | 2 g |
| Sodium sulfite | 20 g |
| Hidroquinone monosulfonate | 30 g |
| Sodium carbonate (monohydrate) | 30 g |
| 1-Phenyl-4-methyl-4-hydroxymethyl-3-pyrazolidone | 2 g |
| Potassium bromide | 2.5 g |
| Potassium thiocyanate | 1.2 g |
| Potassium iodide (0.1% solution) | 2 ml |
| Water to make | 1,000 ml |
| Reversing solution | |
| Water | 700 ml |
| Pentasodium nitrilo-N,N,N-trimethylene-phosphonate | 3 g |
| Stannous chloride (dihydrate) | 1 g |
| p-Amylphenol | 0.1 g |
| Sodium hydroxide | 8 g |
| Glacial acetic acid | 15 ml |
| Water to make | 1,000 ml |
| Color developing solution | |
| Water | 700 ml |
| Pentasodium nitrilo-N,N,N-trimethylene-phosphonate | 3 g |
| Sodium sulfite | 7 g |
| Tribasic sodium phosphate (dodecahydrate) | 36 g |
| Potassium bromide | 1 g |
| Potassium iodide (0.1% solution) | 90 ml |
| Sodium hydroxide | 3 g |
| Citrazinic acid | 1.5 g |
| N-ethyl-N-(β-methanesulfonamideethyl)-3-methyl-4-aminoaniline sulfate | 11 g |
| 3,6-dithioctane-1,8-diol | 1 g |
| Water to make | 1,000 ml |
| Adjusting solution | |
| Water | 700 ml |
| Sodium sulfite | 12 g |
| Sodium ethylenediaminetetraacetate (dihydrate) | 8 g |
| Thioglycerin | 0.4 ml |
| Glacial acetic acid | 3 ml |
| Water to make | 1,000 ml |
| Bleaching solution | |
| Water | 800 ml |
| Sodium ethylenediaminetetraacetate (dihydrate) | 2 g |
| Ferric ammonium ethylenediaminetetra-acetate (dihydrate) | 120 g |
| Potassium bromide | 100 g |
| Water to make | 1,000 ml |
| Fixing solution | |
| Water | 800 ml |
| Sodium thiosulfate | 80.0 g |
| Sodium sulfite | 5.0 g |
| Sodium bisulfite | 5.0 g |
| Water to make | 1,000 ml |
| Stabilizing solution | |
| Water | 800 ml |
| Formalin (37 wt %) | 5.0 ml |

-continued

| | |
|---|---|
| "Fuji Driwel" (Fuji Film Co., Ltd.'s surface active agent) | 5.0 ml |
| Water to make | 1,000 ml |

These samples were then checked for magenta density to determine the photographic properties thereof. The results reflected the results obtained in Examples 1 and 3. Sample 102 had a sensitivity about 30% higher than Sample 101. The two samples had similar graininess. Sample 102 had a higher gradation than Sample 101.

EXAMPLE 5

Emulsions 4-A and 4-B as shown in Example 4 were optimally chemically sensitized.

Multilayer color light-sensitive material samples 201 and 202 were prepared by coating various layers of the undermentioned compositions on an undercoated cellulose triacetate film support. These samples contained Emulsion 4-A and 4-B in the 3rd green-sensitive layer.

| | |
|---|---|
| First layer: Antihalation layer | |
| Black colloidal silver | 0.18 g/m² as silver |
| Gelatin | 1.40 g/m² |
| Second layer: Intermediate layer | |
| 2,5-di-t-pentadecylhydroquinone | 0.18 g/m² |
| C-11 | 0.07 g/m² |
| C-13 | 0.02 g/m² |
| U-11 | 0.08 g/m² |
| U-12 | 0.08 g/m² |
| HBS-1 | 0.10 g/m² |
| HBS-2 | 0.02 g/m² |
| Gelatin | 1.0 g/m² |
| Third layer: First red-sensitive emulsion layer | |
| Silver iodobromide emulsion, spectrally sensitized with sensitizing dyes S-11, 12, 13 and 18 (an emulsion of thick plate like grains having an iodide content of 2 mol % and an average grain diameter of 0.3 μm in terms of sphere) | 0.5 g/m² as silver |
| C-12 | 0.14 g/m² |
| HBS-1 | 0.005 g/m² |
| C-20 | 0.005 g/m² |
| Gelatin | 1.20 g/m² |
| Fourth layer: Second red-sensitive emulsion layer | |
| Silver iodobromide emulsion spectrally sensitized with sensitizing dyes S-11, 12, 13 and 18 (emulsion of thick plate like grains having an iodide content of 2 mol % and an average grain diameter of 0.6 μm in terms of sphere) | 1.15 g/m² as silver |
| C-12 | 0.060 g/m² |
| C-13 | 0.008 g/m² |
| C-20 | 0.004 g/m² |
| HBS-1 | 0.005 g/m² |
| Gelatin | 1.50 g/m² |
| Fifth layer: Third red-sensitive emulsion layer | |
| Silver iodobromide emulsion spectrally sensitized with sensitizing dyes S-11, 12, 13 and 18 (an emulsion of thick plate like grains having an iodide content of 2 mol % and an average grain diameter of 0.8 μm in terms of sphere) | 1.50 g/m² as silver |
| C-15 | 0.012 g/m² |
| C-13 | 0.003 g/m² |
| C-14 | 0.004 g/m² |
| HBS-1 | 0.32 g/m² |
| Gelatin | 1.63 g/m² |
| Sixth layer: Intermediate layer | |
| Gelatin | 1.06 g/m² |
| Seventh layer: First green-sensitive emulsion layer | |
| Silver iodobromide emulsion, spectrally sensitized with sensitizing dyes S-14, 15, and 16 (an emulsion of thick plate like grains having an iodide content of 2 mol % and an average grain diameter of 0.3 μm in terms of sphere) | 0.35 g/m² as silver |
| C-16 | 0.120 g/m² |
| C-11 | 0.021 g/m² |
| C-17 | 0.030 g/m² |
| C-18 | 0.025 g/m² |
| HBS-1 | 0.20 g/m² |
| Gelatin | 0.70 g/m² |
| Eighth layer: Second green-sensitive emulsion layer | |
| Silver iodobromide emulsion, spectrally sensitized with sensitizing dyes S-14, 15, and 16 (an emulsion of thick plate-like grains having an iodide content of 2 mol % and an average particle diameter of 0.6 μm in terms of sphere) | 0.75 g/m² as silver |
| C-16 | 0.021 g/m² |
| C-18 | 0.004 g/m² |
| C-11 | 0.002 g/m² |
| C-17 | 0.003 g/m² |
| HBS-1 | 0.15 g/m² |
| Gelatin | 0.80 g/m² |
| Ninth layer: Third green-sensitive emulsion layer | |
| Emulsion A or B, spectrally sensitized with sensitizing dyes S-14, 15, and 16 | 1.80 g/m² as silver |
| C-16 | 0.011 g/m² |
| C-11 | 0.001 g/m² |
| HBS-2 | 0.69 g/m² |
| Gelatin | 1.74 g/m² |
| Tenth layer: Yellows filter layer | |
| Yellow colloidal silver | 0.05 g/m² as silver |
| 2,5-Di-pentadecyl hydroquinone | 0.03 g/m² |
| Gelatin | 0.95 g/m² |
| Eleventh layer: First blue-sensitive emulsion layer | |
| Silver iodobromide emulsion, spectrally sensitized with asensitizing dye S-17 (an emulsion of thick plate like grains having an iodide content of 2 mol % and an average grain diameter of 0.3 μm in terms of sphere) | 0.24 g/m² as silver |
| C-19 | 0.27 g/m² |
| C-18 | 0.005 g/m² |
| HBS-1 | 0.28 g/m² |
| Gelatin | 1.28 g/m² |
| Twelfeth layer: Second blue-sensitive emulsion layer | |
| Silver iodobromide emulsion, spectrally sensitized with asensitizing dye S-17 (an emulsion of thick plate like grains having an iodide content of 2 mol % and an average particle diameter of 0.6 μm in terms of sphere) | 0.45 g/m² as silver |
| C-19 | 0.098 g/m² |
| HBS-1 | 0.03 g/m² |
| Gelatin | 0.46 g/m² |
| Thirteenth layer: Third blue-sensitive emulsion layer | |
| Silver iodobromide emulsion, spectrally sensitized with asensitizing dyes S-17 (same emulsion as used in the 3rd green-sensitive emulsion layer) | 0.77 g/m² as silver |
| C-19 | 0.036 g/m² |
| HBS-1 | 0.07 g/m² |
| Gelatin | 0.69 g/m² |
| Fourteenth layer: First protective layer | |
| Silver iodobromide (iodide content: 1 mol %; average grain diameter: 0.7 μm) | 0.5 g/m² as silver |
| U-11 | 0.11 g/m² |
| U-12 | 0.17 g/m² |
| HBS-1 | 0.90 g/m² |
| Fifteenth layer: Second protective layer | |
| Particulate polymethylmethacrylate (diameter: about 1.5 μm) | 0.54 g/m² as silver |
| U-13 | 0.15 g/m² |
| U-14 | 0.10 g/m² |

-continued

| | |
|---|---|
| Gelatin | 0.72 g/m² |

Besides the above described components, a gelatin film hardener H-3 and a surface active agent were added to each layer.

Samples 201 and 202 thus prepared were then exposed to light of 4,800 K through an optical wedge for 1/100 second, and subjected to the following development process.

| Processing step (at 38° C.) | Processing time |
|---|---|
| Color development | 3 min. 15 sec. |
| Bleaching | 6 min. 30 sec. |
| Rinse | 2 min. 10 sec. |
| Fixing | 4 min. 20 sec. |
| Rinse | 3 min. 15 sec. |
| Stabilizing | 1 min. 05 sec. |

The composition of the processing solutions used at the processing steps were as follows:

| Color developing solution | |
|---|---|
| Diethylenetriaminepentaacetic acid | 1.0 g |
| 1-Hydroxyethylidene-1,1-diphosphonic acid | 2.0 g |
| Sodium sulfite | 4.0 g |
| Potassium carbonate | 30.0 g |
| Potassium bromide | 1.4 g |
| Potassium iodide | 1.3 mg |
| Hydroxyamine sulfate | 2.4 g |
| 4-(N-ethyl-N-β-hydroxyethylamino)-2-methylaniline sulfate | 4.5 g |
| Water to make | 1.0 l |
| pH | 10.0 |
| **Bleaching solution** | |
| Ferric ammonium ethylenediaminetetraacetate | 100.0 g |
| Disodium ethylenediaminetetraacetate | 10.0 g |
| Ammonium bromide | 150.0 g |
| Ammonium nitrate | 10.0 g |
| Water to make | 1.0 l |
| pH | 6.0 |
| **Fixing solution** | |
| Disodium ethylenediaminetetraacetate | 1.0 g |
| Sodium sulfite | 4.0 g |
| 70% aqueous solution of ammonium thiosulfate | 175.0 ml |
| Disodium bisulfite | 4.6 g |
| Water to make | 1.0 l |
| pH | 6.6 |
| **Stabilizing solution** | |
| Formalin (40%) | 2.0 ml |
| Polyoxyethylene-p-monononylphenylether (average polymerization degree: 10) | 0.3 g |
| Water to make | 1.0 l |

These samples were then checked for magenta density to determine the photographic properties thereof. The results were the same as obtained in Example 4. Sample 202 showed a sensitivity about 35% higher than Sample 201. Samples 201 and 202 had similar graininess. Sample 202 had a higher gradation and showed a less fog than Sample 201.

Structural formula of the compounds used in Examples 4 and 5

C-1

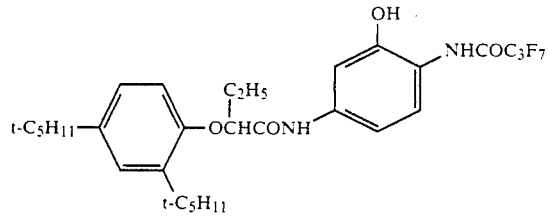

C-2

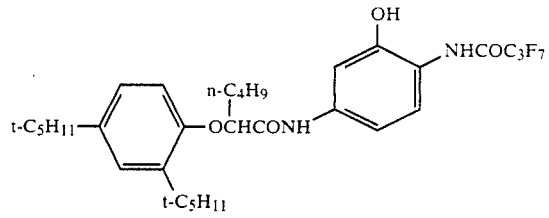

C-3

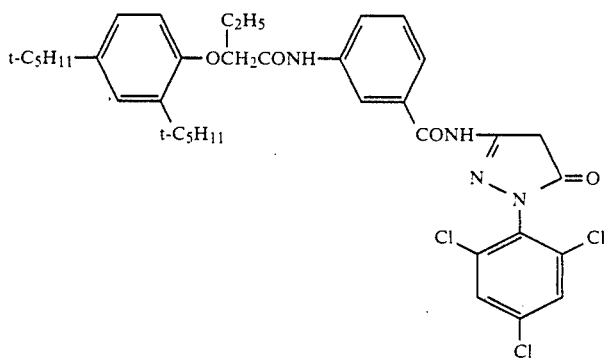

-continued
Structural formula of the compounds used in Examples 4 and 5
C-4
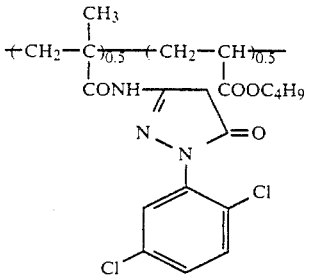
Average molecular weight: about 40,000
C-5
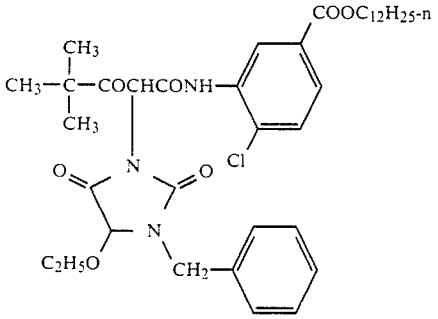
C-11
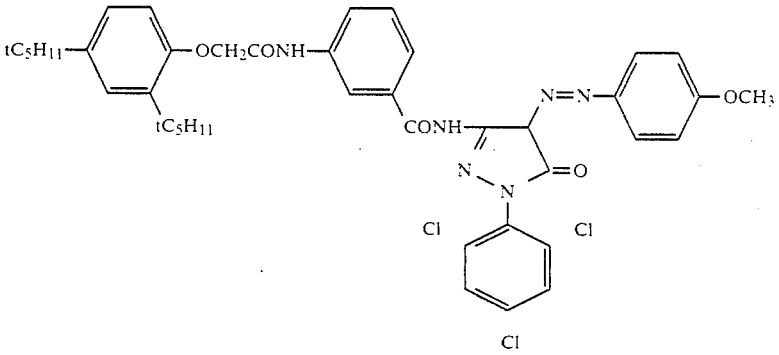
C-12
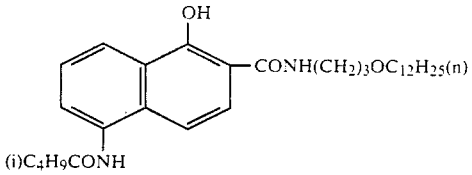
C-13
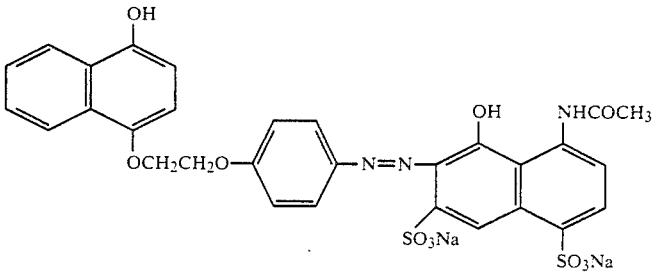
C-14
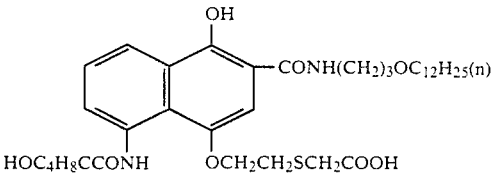

-continued
Structural formula of the compounds used in Examples 4 and 5
C-15
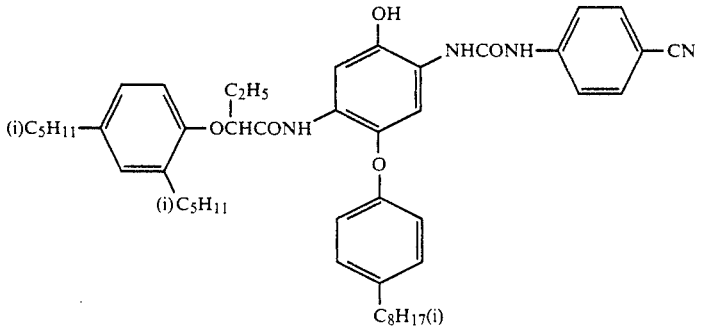
C-16
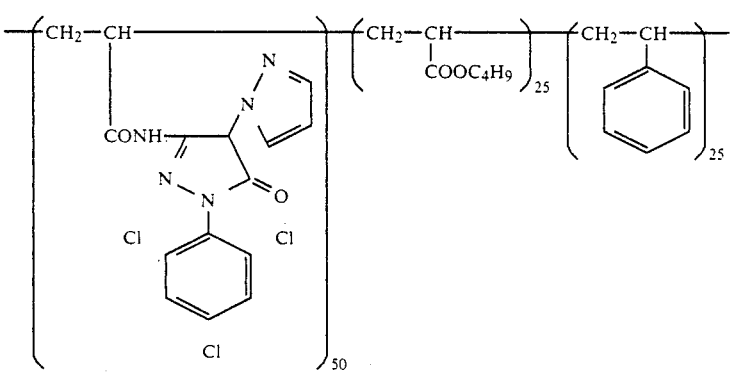
Average molecular weight: about 30,000
C-17
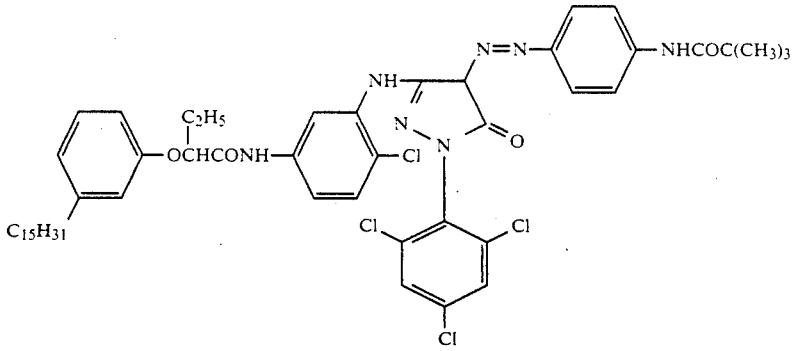
C-18
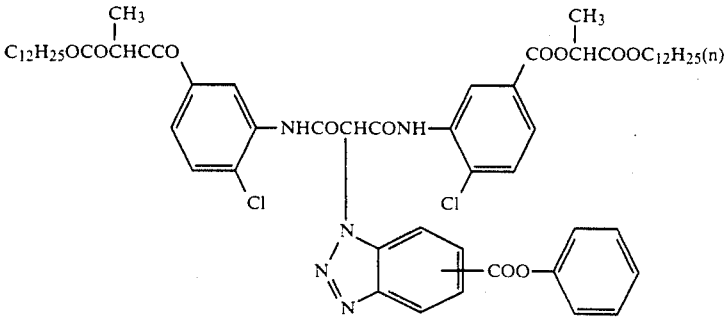

-continued
Structural formula of the compounds used in Examples 4 and 5
C-19
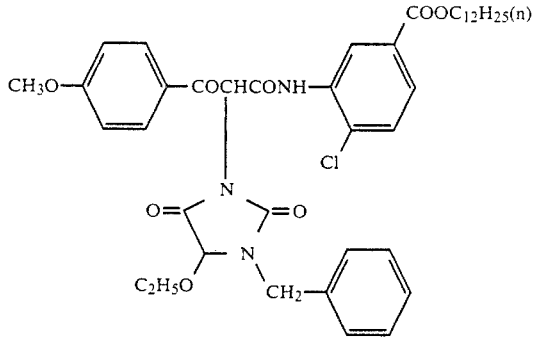
C-20
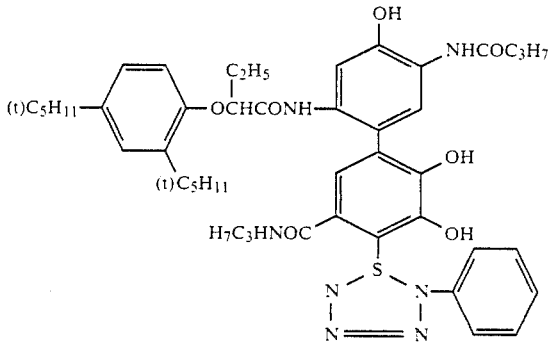
S-1
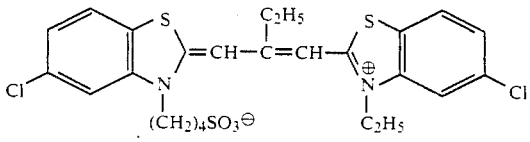
S-2
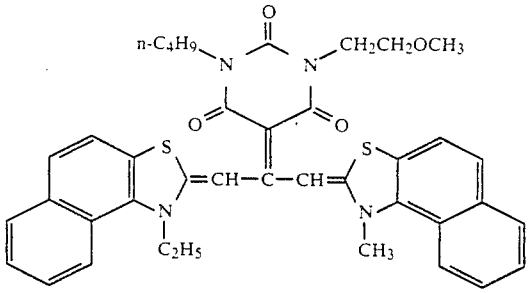
S-3
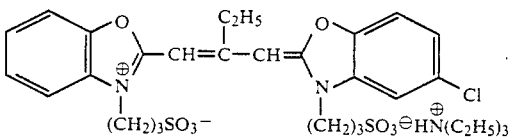
S-4
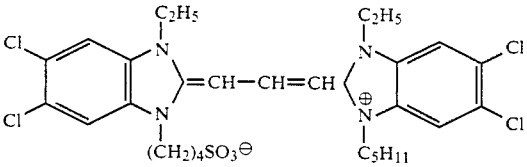

-continued
Structural formula of the compounds used in Examples 4 and 5
S-5
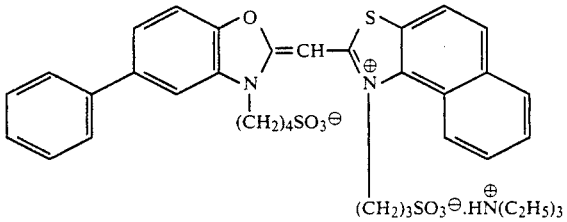
S-11
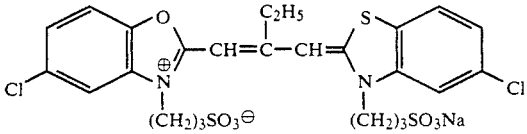
S-12
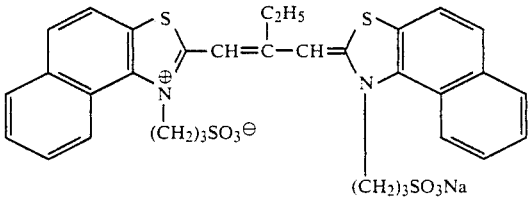
S-13
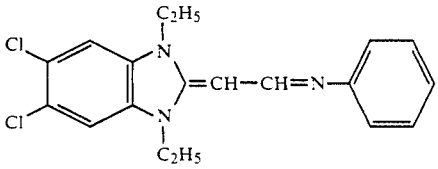
S-14
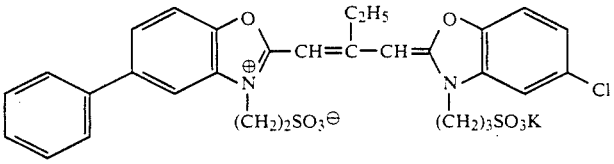
S-15
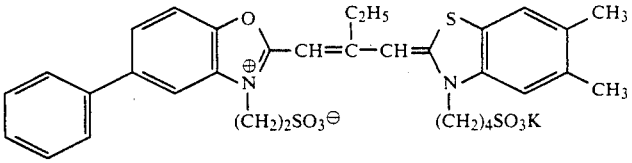
S-16
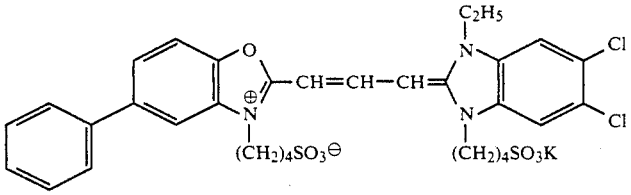
S-17
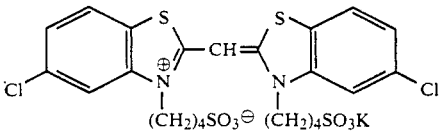

-continued
Structural formula of the compounds used in Examples 4 and 5
S-18
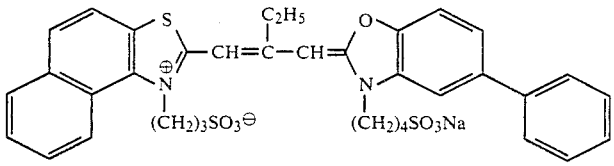
U-1
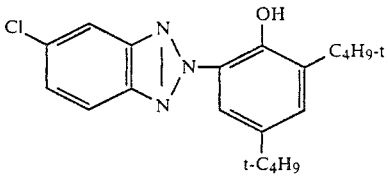
U-2
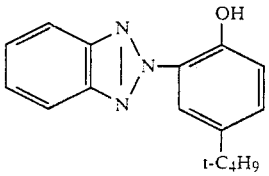
U-3
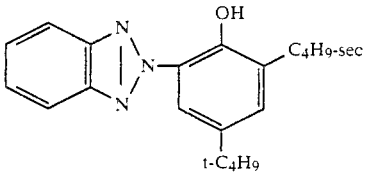
U-4
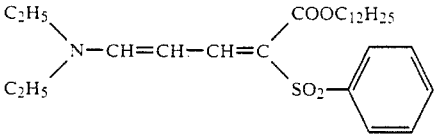
U-11
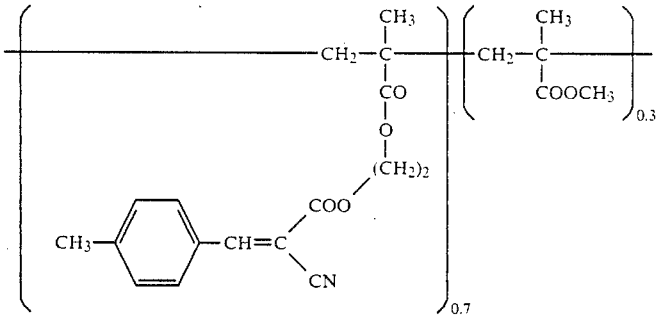
Average molecular weight: about 30,000
U-12
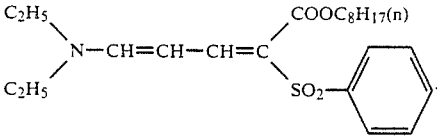
U-13
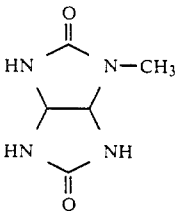

-continued

| Structural formula of the compounds used in Examples 4 and 5 | |
|---|---|
| 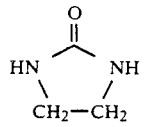 | U-14 |
| Tricresylphosphate | HBS-1 |
| Dibutylphthalate | HBS-2 |
| 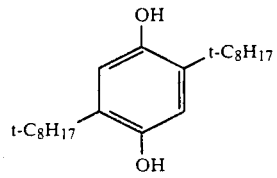 | H-1 |
| 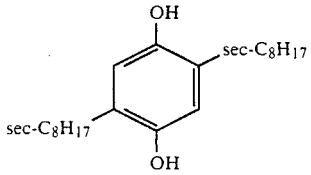 | H-2 |
| $CH_2{=}CHSO_2CH_2CONHCH_2$ / $CH_2{=}CHSO_2CH_2CONHCH_2$ | H-3 |
| 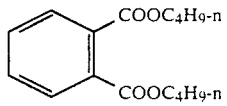 | O-1 |
| 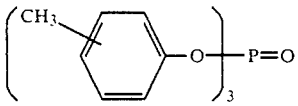 | O-2 |

EXAMPLE 6

Emulsion 6-A: Tabular grain having AgCl epitaxy coordinated in the center of its major faces 300 cc of distilled water was added to 500 g of Emulsion 2-A obtained in Example 2 (corresponding to 0.4 mol-Ag). The reaction mixture was then heated to a temperature of 70° C. 15 cc of 25 % ammonia water was added to the reaction mixture. The reaction mixture was then physically ripened for 30 minutes. 15 cc of glacial acetic acid was then added to the reaction mixture. The reaction mixture was reduced to a temperature of 40° C. 0.008mol of silver nitrate solution and 0.008 mol of sodium chloride solution were added to the reaction mixture in a double jet process in 4 minutes. The emulsion thus obtained was cooled. The emulsion was then washed in an ordinaty flocculation process. 35 g of gelatin was added to the emulsion and then dissolved in the emulsion. The emulsion was then adjusted to a pH value of 6.5 and a pAg value of 8.3. The tabular grains contained in the emulsion thus obtained had a silver chloride epitaxy coordinated only in the center of its major faces. No silver chloride epitaxy was grown in the other portions in the grains.

Comparative emulsion 6-B 300 cc of distilled water was added to 500 g of Emulsion 2-A, as shown in Example 2 (corresponding to 0.4 mol Ag). 0.008 mol of silver nitrate solution and 0.008 mol of sodium chloride solution were added to the reaction mixture in a double jet process at a temperature of 40° C. in 4 minutes. The emulsion thus obtained was then cooled. The emulsion was washed in an ordinary flocculation process. 35 g of gelatin was dissolved in the emulsion. The emulsion was adjusted to a pH value of 6.5 and a pAg of 8.3. The tabular grains contained in the emulsion thus obtained had silver chloride epitaxies coordinated therein. However, these silver chloride epitaxies were scattered in the apexes, edges, and center. The grains having silver chloride epitaxies coordinated in the center thereof accounted for only 36 % of all the grains. Even the grains having silver chloride epitaxies coordinated in the center thereof had silver chloride epitaxies coordinated also in the apexes and edges thereof.

EXAMPLE 7

Emulsion 7-A: Tabular grain which form an internal latent image in the center of its major faces 300 cc of distilled water was added to 500 g of Emulsion 1-B as shown in Example 1 (corresponding to 0.4 mol Ag) in the form of a core emulsion. After dissolution, the emulsion was heated to a temperature of 70° C. 40 mg of 3,4-dimethyl-1,3-thiazoline-2-thione was added to the emulsion. 1 mg of sodium thiosulfate and 1 mg of potassium chloroautate were then added to the emulsion. The emulsion was then chemically sensitized at a temperature of 70° C. for 70 minutes. 0.02 mol of a silver nitrate solution and 0.02 mol of a potassium bromide solution were added to the emulsion in a double jet process in 5 minutes to form shells. The emulsion was then cooled. The emulsion was washed in an ordinaty flocculation process. 35 g of gelatin was dissolved in the emulsion. The emulsion was then adjusted to a pH value of 6.5 and a pAg of 8.7. In the emulsion thus obtained, the core emulsion grains had chemically-sensitized nucleus formed in an indentation in the center of its major faces. The formation of shell of silver chloride or silver bromochloride preferentially took place in the center of the indentation. The silver molar ratio of core to shell was 20:1.

Heretofore, the preparation of core/shell internal latent image type grains has been accomplished by chemically sensitizing cores, and the further depositing silver halide of the cores to form a shell thereon. It is important that the shell is uniformly formed over the surface of the grains to enclose the light-sensitive nuclei. However, if the present CE-grains are used, the formation of light-sensitive nuclei and the formation of shells preferentially take place in an indentation in the center of the major faces. Therefore, only a slight amount of silver is required for the formation of a shell. 0.4 mg of sodium thiosulfate and 10 mg of poly(N-vinylpyrrolidone) were then added to the core/shell tabular grain emulsion thus obtained. The surface of the grain was then chemically sensitized at a temperature of 60° C. for 50 minutes.

Comparative emulsion 7B

An internal latent image type emulsion was prepared in the same manner as in Emulsion 1-A shown in Example 1 except in that the following process was added.

150 g of silver nitrate and a potassium bromide solution containing 10 mol% potassium iodide were added to the emulsion in equimolecular amounts in accelerated flow rates (i.e., the flow rate at the end was 15 times that at the beginning) for 55 minutes out of 80 minutes. 40 mg of 3,4-dimethyl-1,3-thiazoline-2-thione was added to the emulsion. 3 mg of sodium thiosulfate and 1 mg of potassium chloroaurate were added to the emulsion. The emulsion was then chemically sensitized at a temperature of 70° C. for 70 minutes. The addition of silver nitrate and the potassium bromide solution which had been once suspended was resumed to continue the growth of grains so that shell was formed. The silver molar ratio of core to shell was 1:1. The emulsion thus obtained was washed in an ordinary flocculation process. 80 g of gelatin was dissolved in the emulsion. The emulsion was then adjusted to a pH value of 6.5 and a pAg value of 8.7. 0.6 mg of sodium thiosulfate and 10 mg of poly(N-vinylpyrrolidone) were added to the core/shell type emulsion thus obtained. The surface of the grains was chemically sensitized at a temperature of 60° C. for 50 minutes.

Preparation of light-sensitive sheet

A light-sensitive sheet (A) was prepared by coating layers (1) to (6) in the order as described hereinafter on a transparent polyethylene terephthalate support.

Layer (6): Protective layer containing gelatin
Layer (5): Red sensitive direct positive emulsion layer
Layer (4): Layer containing cyan DRR compound
Layer (3): Backing layer
Layer (2): White reflective layer
Layer (1): Mordant layer Support Each layer composition was as follows:

Layer (1): Mordant layer containing: 3.0 g/m$^2$ of a copolymer as described in U.S. Pat. No. 3,898,088, containing repeating units represented by the following formula; and 3.0 mg/m$^2$ of gelatin.

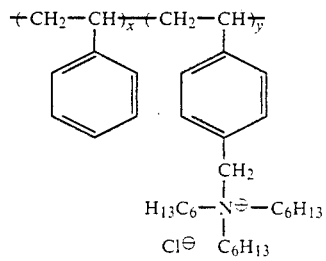

x:y = 50:50
Average molecular weight: about 50,000-100,000

Layer (2): White reflective layer containing 20 g/m$^2$ of titanium oxide and 2.0 g/m2 of gelatin Layer (3): Backing layer containing 20 g/m$^2$ of carbon black and 1.5 g/m$^2$ of gelatin Layer (4): Layer containing 0.44 g/m$^2$ of the following cyan DDR compound, 0.09 g/m$^2$ of tricyclohexyl phosphate, and 0.8 g/m$^2$ of gelatin

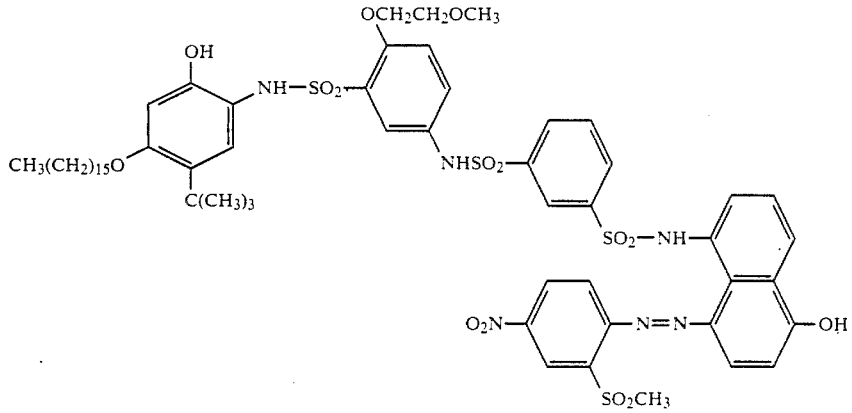

Layer (5): Red-sensitive core/shell type direct positive silver bromide emulsion containing 0.81 g/m$^2$ (as calculated in terms of silver) of Emulsions 7A and 7B prepared in the above-described manner, 0.01 g/m$^2$ of 1-formyl-2-[4-[3-(3-phenylureide) benzamide]phenyl]-hydrazine, 4.3 g/m$^2$ of 4-hydroxy-6-methyl-1,3,3a-tetrazaindene (as described in Japanese Patent Application (OPI) No. 74729/79), and 0.11 g/m$^2$ of sodium 5-pentadecylhydroquinone-2-sulfonate Layer (6): Protective layer containing 1.0 g/m$^2$ of gelatin Combinations of the above described light-sensitive sheet and the undermentioned various elements were exposed to light, developed, and measured for photographic properties ($D_{max}$ and $D_{min}$).

| Processing solution | |
|---|---|
| 1-p-Tolyl-4-methl-4-hydroxymethyl-3-pyrazolidone | 12.0 g |
| Methyl hydroquinone | 0.3 g |
| 5-Methylbenzotriazole | 3.5 g |
| Sodium sulfite | 2.0 g |
| Sodium carboxymethyl cellulose | 58 g |
| Potassium hydroxide | 56 g |
| Benzyl alcohol | 1.5 g |
| Carbon black dispersion (25%) | 600 g |
| Water to make | 1 kg |

Each 0.8 g of the above described processing solution was packed in pressure-rupturable containers.

Cover sheet

A cover sheet was prepared by coating the layers (1') to (3') described below, on a transparent polyethylene terephthalate support in the order described hereinafter.

Layer (1'): Neutralizing layer containing 22 g/m$^2$ of a 80:20(by weight) copolymer of acrylic acid and butyl acrylate and 0.44 g/m$^2$ of 1,4-bis(2,3-epoxypropoxy)butane Layer (2'): Layer containing 3.8 g/m$^2$ of acetyl cellulose (obtained by hydrolyzing 100 g of acetyl cellulose to produce 39.4 g of acetyl group), 0.2 g/m$^2$ of a 60:40 (by weight) copolymer of styrene and maleic anhydrate (molecular weight: about 50,000), and 0.115 g/m$^2$ of 5-($\beta$-cyanoethylthio)-1-phenyltetrazole Layers (3'): Layer containing 2.5 g/m$^2$ of a 85: 12:3 (by weight) copolymer latex of vinylidene chloride, methylacrylate, and acrylic acid and 0.05 g/m$^2$ of polymethyl methacrylate (particle diameter: 1 to 3 $\mu$m)

Exposure to light and development

The above described cover sheet and each of the above described light-sensitive sheets were laminated. The lamination was then imagewise exposed to a xenon flash light through a continuously graded wedge on the cover sheet side thereof for $10^{-2}$ second. The developing solution was spread over between the two sheets to a thickness of 75 $\mu$m by means of a pressure roller. The lamination was then processed at a temperature of 25° C. After 1 hour passed, the lamination was measured through the transparent support in the light-sensitive sheet for cyan color density of transfer images produced on the mordant layer (image receiving layer) by means of a Macbeth reflective densitometer. The results are shown in Table 6.

Table 6 shows that the light-sensitive sheet comprising the emulsion according to the present invention exhibits a higher reversal sensitivity and lower rereversal sensitivity than the other comparative light-sensitive sheets.

TABLE 6

| Emulsion | Red-sensitive sensitizing dye | $D_{max}$ | Relative reversal sensitivity (D = 0.5) | Relative re-reversal sensitivity (D = 0.5) |
|---|---|---|---|---|
| 7A | None | 2.0 | 120 | * |
| 7A | Used | 2.5 | 200 | 0.1 |
| 7B | None | 2.1 | 100 | * |
| 7B | Used | 2.5 | 150 | 0.5 |

* No re-reversal was observed in the exposure range used.

While the invention has been described in detail and with reference to specific embodiments thereof, it will be apparent to one skilled in the art that various changes and modifications can be made therein without departing from the spirit and scope thereof.

What is claimed is:

1. A silver halide photographic emulsion comprising a dispersant and silver halide grains, at least 50% of the total projected area of said silver halide grains being occupied by tabular grains having an average aspect ratio of 2 or more, said tabular grains comprising opposing parallel major faces consisting of a (1 1 1) face, and at least 30% of said tabular grains having an indentation or space in the central portion of the major faces thereof and the halogen composition of said tabular grains is arranged so that the solubilities of the central portions of said grains are higher than those of the surrounding portions.

2. A silver halide photographic emulsion as in claim 1, wherein the central portion of said tabular grains comprises AgBr and the surrounding portion thereof comprises AgBrI with an iodine content of 3 mol% or more.

3. A silver halide photographic emulsion as in claim 1, wherein the central portion of said tabular grains comprises AgBrI with an iodine content of 3 mol% or less and the surrounding portion thereof comprises AgBrI with an iodine content of 6 mol% or more.

4. A silver halide photographic emulsion as in claim 1,. wherein the central portion of said tabular grains comprises AgClBr and the surrounding portion thereof comprises AgBr, AgBrI or AgClBr in which the Br content is 10 mol% higher than that of the central portion.

5. A silver halide photographic emulsion as in claim 1, wherein the central portion of said tabular grains comprises AgCl and the surrounding portion thereof comprises AgBr or AgClBr.

6. A silver halide photographic emulsion as in claim 1, wherein the central portion of said tabular grains accounts for 0.5 to 10% by weight of the total tabular grains.

7. A silver halide photographic emulsion as in claim 1, wherein said tabular grains are monodispersed hexagonal tabular grains.

8. A silver halide photographic emulsion as in claim 1, wherein the diameter of said indentations calculated in terms of a sphere is in the range of 0.005 to 1.0 $\mu$m.

9. A silver halide photographic emulsion as in claim 1, wherein the depth of said indentations is 50 lattices or more.

10. A silver halide photographic emulsion as in claim 1, wherein said tabular grains have an average aspect ratio of from 3 to 20.

11. A silver halide photographic emulsion as in claim 1, wherein the size of said tabular grains is at least 0.4 micron.

12. A silver halide photographic emulsion as in claim 1, wherein said dispersant is gelatin.

* * * * *